US009687408B2

(12) United States Patent
Nagasaka et al.

(10) Patent No.: US 9,687,408 B2
(45) Date of Patent: Jun. 27, 2017

(54) EXERCISE SUPPORT APPARATUS AND EXERCISE SUPPORT METHOD

(71) Applicant: SONY CORPORATION, Tokyo (JP)

(72) Inventors: Kenichiro Nagasaka, Tokyo (JP); Masakuni Nagano, Chiba (JP); Yasuhide Hosoda, Kanagawa (JP); D. Forrest Matthew, Kanagawa (JP)

(73) Assignee: Sony Corporation, Tokyo (JP)

( * ) Notice: Subject to any disclaimer, the term of this patent is extended or adjusted under 35 U.S.C. 154(b) by 644 days.

(21) Appl. No.: 14/036,133

(22) Filed: Sep. 25, 2013

(65) Prior Publication Data

US 2014/0148738 A1 May 29, 2014

(30) Foreign Application Priority Data

Nov. 28, 2012 (JP) ..... 2012259827

(51) Int. Cl.
*A61H 3/00* (2006.01)
*A61H 1/02* (2006.01)

(52) U.S. Cl.
CPC ..... *A61H 3/00* (2013.01); *A61H 1/0262* (2013.01); *A61H 2201/1215* (2013.01); *A61H 2201/149* (2013.01); *A61H 2201/164* (2013.01); *A61H 2201/165* (2013.01); *A61H 2201/1628* (2013.01); *A61H 2201/5007* (2013.01); *A61H 2201/5061* (2013.01); *A61H 2201/5069* (2013.01)

(58) Field of Classification Search
CPC ..... A61H 3/00; A61H 1/0262; A61H 2201/1664; A61H 2201/163; A61H 2201/165; A61H 2201/1246; A61H 2003/007; A61H 2003/043; A61F 5/0102; B25J 9/0006
See application file for complete search history.

(56) References Cited

U.S. PATENT DOCUMENTS 406,328 A * 7/1889 Yagn ..... A63B 25/10 297/4
4,872,665 A * 10/1989 Chareire ..... A61H 1/0237 482/51

(Continued)

FOREIGN PATENT DOCUMENTS

JP 4641225 12/2010
JP 2011-062463 3/2011

(Continued)

OTHER PUBLICATIONS

Hiroaki Kawamoto, et al., "Power Assist Method for HAL-3 using EMG-based Feedback Controller", 2003, pp. 1648-1653, IEEE.

(Continued)

*Primary Examiner* — Justine Yu
*Assistant Examiner* — Timothy Stanis
(74) *Attorney, Agent, or Firm* — Paratus Law Group, PLLC

(57) ABSTRACT

There is provided an exercise support apparatus including a leg rod connected to a waist region and a foot region of a user and including a linear motion actuator, a waist connecting section configured to connect one end of the leg rod to the waist region, and a foot region connecting section configured to connect the other end of the leg rod to the foot region.

20 Claims, 22 Drawing Sheets

(56) References Cited

U.S. PATENT DOCUMENTS

| | | | | |
|---|---|---|---|---|
| 9,375,377 | B1 * | 6/2016 | Edwards | A61H 3/00 |
| 2006/0270951 | A1 * | 11/2006 | Ikeuchi | A61H 3/00 601/5 |
| 2009/0199883 | A1 * | 8/2009 | Hiki | A61H 1/0237 135/65 |
| 2009/0292369 | A1 * | 11/2009 | Kazerooni | A61H 3/00 623/27 |
| 2010/0210980 | A1 * | 8/2010 | Kudoh | A61H 3/008 601/34 |
| 2011/0166489 | A1 * | 7/2011 | Angold | A61H 1/0255 601/34 |
| 2012/0226203 | A1 * | 9/2012 | Nakashima | A61H 3/00 601/34 |

FOREIGN PATENT DOCUMENTS

| | | |
|---|---|---|
| JP | 2011-067227 | 4/2011 |
| JP | 4715863 | 4/2011 |

OTHER PUBLICATIONS

Justin Ghan, et al., "Control and system identification for the Berkeley lower extremity exoskeleton (BLEEX)", Advanced Robotics, 2006, pp. 989-1014, vol. 20, VSP and Robotics Society of Japan.

* cited by examiner

EXERCISE SUPPORT APPARATUS AND EXERCISE SUPPORT METHOD

CROSS REFERENCE TO RELATED APPLICATIONS

This application claims the benefit of Japanese Priority Patent Application JP 2012-259827 filed Nov. 28, 2012, the entire contents of which are incorporated herein by reference.

BACKGROUND

The technology of the present disclosure relates to an exercise support apparatus and an exercise support method mounted and used on a human body of an elderly person or the like who mainly wants assistance or care and configured to physically and mentally support exercise of a human body that includes a walking motion.

The rate of aging in Japan (a rate occupied by the elderly population of 65 years or more with respect to total population) reached 23.1% in 2010 and is expected to arrive at 30% in 2025. When a rate occupied by the elderly population rapidly increases as described above, realization of a society in which the elderly can live their lives as healthily and actively as possible rather than in a primary nursing care state, and even in a primary nursing care state can prevent deterioration as much as possible and live their independent lives becomes urgent.

According to arrival of the aging society, in an elderly care facility or a family including elderly members, requirements of a mechatronics instrument for the purpose of support of mind and body of the elderly is increased. Most of all, there is a high demand for a machine configured to perform physical assistance such as an autonomous walking assistance device or a power assist suit.

One of important points in development of a mechatronics instrument for assistance and care is to maintain and accelerate activities of the elderly as much as possible without unnecessary interference. When the activities of the elderly are excessively undertaken by a machine due to reduced physical fitness of the elderly, the physical fitness of the elderly is further weakened and circumstances also deteriorate (disuse syndrome). The power assist suit is an apparatus configured to apply an artificial force as an auxiliary force in addition to a force generated by a human's muscle. Accordingly, the apparatus is an exemplary instrument in that the elderly person's own activity is maintained while supplementing a decrease in the physical fitness of the elderly person.

Assistance with the force for the elderly is becoming technically possible. However, in recent times, a proliferation rate of the power assist suit has not been very high. This may be considered as being caused by the following reasons.

(1) Attachment and detachment of the apparatus is not easy. In addition, long term use may cause discomfort.

(2) Price is high, and cost effectiveness is not good.

(3) Appearance upon mounting is unnatural and awkward, and thus external competitiveness in market is reduced.

(4) A wide range of exercise support of a user from sitting to walking may not be performed.

(5) The weight of the instrument is applied to the user, and only the awkward support is merely performed. In addition, a lateral reverse moment may easily occur due to a support force.

(6) Dependence on a body size of the user is high.

(7) A working time is short.

For example, a force control type power assist suit configured to apply a drive force to a joint based on an output from a myoelectric sensor and a result of phase estimation of an exercise has been receiving attention in recent times (for example, see Kawamoto H., Lee S., Kanbe S., Sankai Y.: "Power Assist Method for HAL-3 using EMG-based Feedback Controller", Proc. of Int'l Conf. on Systems, Man and Cybernetics (SMC2003), pp. 1648-1653, 2003). However, according to the power assist suit, at least nine myoelectric sensors should be attached to one leg, and thus mounting labor is largely consumed. In addition, the myoelectric sensor may be separated from the skin due to changes over time or sweat. When adhesion between the myoelectric sensor and the skin is broken, an output value of the myoelectric sensor may become unstable, the power assist suit may malfunction, or an inappropriate force may be applied to a human body wearing the suit. Such insufficiency has interfered with proliferation of the power assist suit.

On the other hand, a human body support apparatus not using the myoelectric sensor has also been proposed (for example, see J. Ghan. R. Steger, Kazerooni, H, "Control and System Identification for the Berkeley Lower Extremity Exoskeleton", Advanced Robotics, Volume 20, Number 9, pp. 989-1014, Number 9, 2006). The human body support apparatus is configured to sense movement of a user's joint and apply a force to the joint to support the movement. However, since the human body support apparatus is a structure mounted on the outside of the body, dependence on a size in a widthwise direction of a user's body remains, and the apparatus may be increased in size.

In addition, a boarding type walk support apparatus mounted on the inside of both legs of a user has also been proposed (for example, see Japanese Patent No. 4641225). However, since a knee region of the walk support apparatus largely protrudes from the body, a problem with external appearance occurs. In addition, since an arch-shaped structure is provided under the crotch, the user may not sit on a seat while mounting the walk support apparatus. That is, the walk support apparatus may not perform a wide range of exercise support from sitting to walking.

Further, a walk assist system configured to perform hip joint support according to a phase of walking has been proposed (for example, see Japanese Patent Application Laid-open No. 2011-62463). The walk assist system is constituted by a handstand pendulum type moving body gripped by a user, and a walk support apparatus configured to support an exercise of the user's leg. Then, the handstand pendulum type moving body controls motion of a base body when a user grips and movement based on a target moving speed and the walk support apparatus transmits a force to the user based on motion of the body of a user's leg and the target moving speed such that the target moving speed has a predetermined speed relation between the handstand pendulum type moving body and the walk support apparatus. However, the walk assist system is designed to perform a slight degree of assistance of a swing leg, but may not perform practical force support such as lifting of a weight needed upon ascent of stairs, and raising of the swing leg.

SUMMARY

It is desirable to provide a good exercise support apparatus and exercise support method mainly mounted and used on a human body of an elderly person or the like who wants assistance or care and capable of appropriately physically and mentally supporting exercise of a human body that starts a walking motion.

It is desirable to provide a good exercise support apparatus and exercise support method capable of, in addition to simple assistance of an exercise of a user, easy attachment and detachment, reducing discomfort even through long use, obtaining a high effect at a low cost, removing a problem of external appearance, performing a wide range of exercise support from sitting to walking, and making it difficult to generate a lateral reverse moment by a support force without application of a weight of an instrument to the user.

According to an embodiment of the present technology, there is provided an exercise support apparatus including a leg rod connected to a waist region and a foot region of a user and including a linear motion actuator, a waist connecting section configured to connect one end of the leg rod to the waist region, and a foot region connecting section configured to connect the other end of the leg rod to the foot region.

The linear motion actuator may be operated to expand and contract the leg rod in a longitudinal direction thereof.

The waist connecting section and the foot region connecting section may be connected to the one end and the other end such that the leg rods are disposed inside both left and right legs.

The exercise support apparatus may further include an outfit worn by the user at a trunk and having the waist connecting section.

The outfit may be connected to the one end of the leg rod via the waist connecting section in the vicinity of an anterior abdomen of the user.

The outfit may transmit one direction upward force generated by the linear motion actuator to a pelvis of the user.

The outfit may have a thigh harness annularly surrounding a thigh of the leg of the user, a waist harness annularly surrounding the waist region of the user and connected to the one end of the leg rod, and a substantially linear connecting harness configured to connect the waist harness and the thigh harness.

When the linear motion actuator is expanded and the waist harness is raised upward, as the thigh harness is raised via the connecting harness, an upward force may be transmitted to the pelvis of the user.

The exercise support apparatus may further include a plantar region configured to connect the foot region connecting section having 3 rotational degrees of freedom such that a rotational center of the foot region connecting section is disposed in the vicinity of a subhallucal region of the foot region of the user in forward and rearward directions and in the vicinity of a center of the plantar of the user in a widthwise direction thereof.

The waist connecting section may connect to the one end of the leg rod in the vicinity of a center in the widthwise direction of the pelvis of the user.

The leg rod may be installed at each of the left and right legs of the user, and the waist connecting sections of the left and right leg rods may be disposed to be concentrated at one point.

The leg rod may have a curved section curved toward a front section of the body of the user.

The leg rod may be installed at each of the left and right legs of the user, and the waist connecting section may restrict a movable range about hip roll joints of the left and right leg rods.

The exercise support apparatus may further include a force sensor configured to detect an external force applied to the linear motion actuator, and a control part configured to force-control the linear motion actuator based on an output value of the force sensor.

The exercise support apparatus may further include a ground sensor configured to detect a ground state of the sole of the foot region, and a control part configured to control a motion of the linear motion actuator based on an output value of the ground sensor.

The exercise support apparatus may further include a control part configured to force-control the linear motion actuator such that a pressing force $F_{stance}$ is applied to support a weight according to the flexure amount $\theta_{KPJ}$ of a knee of the user in the leg rod of a stance leg side, and such that a raising force $f_{swing}$ is applied according to the flexure amount $\theta_{HPJ}$ of the hip joint of the user in the leg rod of the swing leg side.

The exercise support apparatus may further include an encoder configured to detect a position of the linear motion actuator. The control part may approximate a flexure amount $\theta_{KPJ}$ of the knee of the user and the flexure amount $\theta_{KPJ}$ of the knee at the position of the linear motion actuator.

The control part may force-control the linear motion actuator in consideration of a force for self-weight compensation to the pressing force $F_{stance}$ in the leg rod of the stance leg side and the raising force $f_{swing}$ in the leg rod of the swing leg side.

The control part may force-control the linear motion actuator so that the raising force $f_{swing}$ for the leg rod of the swing leg side is not applied to the leg rod of the stance leg side.

Further, according to an embodiment of the present technology, there is provided an exercise support method of supporting an exercise of a user wearing the exercise support apparatus, the method including determining a ground state of the foot region, force-controlling the linear motion actuator to apply a raising force $f_{swing}$ according to a flexure amount $\theta_{HPJ}$ of a hip joint of the user in the leg rod of a swing leg side, and force-controlling the linear motion actuator such that a pressing force $F_{stance}$ is applied to support a weight according to the flexure amount $\theta_{KPJ}$ of the knee of the user in the leg rod of a stance leg side.

According to an embodiment of the present disclosure, there is provided an exercise support apparatus configured to fix the apparatus to a user's body through the foot region and the waist region only and connect the foot region and the waist region of the user via leg rods including linear motion actuators. The leg rods are disposed inside both legs, and compensate for the weight of the apparatus, which is lightweight, at a high rate, without receiving influence of a size in a widthwise direction of the body. A connecting section of the leg rods and the waist region is the anterior abdomen of the user. The leg rods are connected to the waist region of the user via a simple harness configured to transmit a one-directional force in an upward direction only to the pelvis of the user. In addition, the leg rods are connected to the foot region to be rotatable with respect to a shoe center section.

According to one or more of embodiments of the present disclosure, a plurality of necessary conditions as described below can be simultaneously satisfied, and the good exercise support apparatus and exercise support method can be provided.

(1) Attachment and detachment are easy.

(2) Discomfort is reduced even in long use.

(3) Cost is low.

(4) Both lift of the user's weight and rising of the swing leg can be supported.

(5) The knee regions do not protrude forward and a problem of external appearance is removed.

(6) A wide range of exercise support from sitting to walking can be performed.

(7) The weight of the apparatus is not easily applied to the user.

(8) A lateral reverse moment is not easily generated by the support force.

(9) Dependence on the body size of the user is low.

(10) The apparatus is small and easily handleable.

Further aspects, features and advantages of the technology of the present disclosure will be apparent by detailed description based on the following embodiments and the accompanying drawings.

DETAILED DESCRIPTION OF THE EMBODIMENTS

Figure 1:
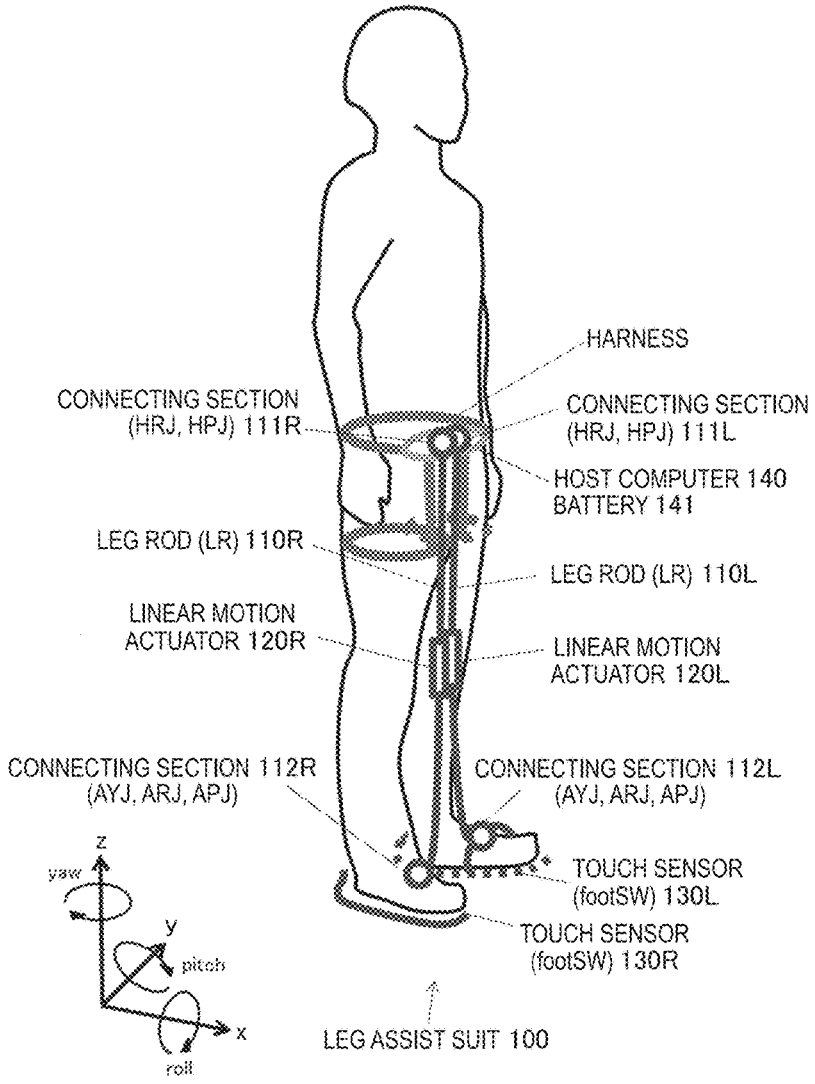
FIG. 1 is a view schematically showing a configuration of a leg assist suit 100 to which the technology of the present disclosure is applied.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

Hereinafter, an embodiment of the technology of the present disclosure will be described in detail with reference to the accompanying drawings.

FIG. 1 schematically shows a configuration of a leg assist suit 100 to which the technology of the present disclosure is applied.

The leg assist suit 100 shown in the drawing is fixed to the body of a user through the waist region and the foot region only to minimize restriction places of the user. The leg assist suit 100 includes leg rods (LR) 110L and 110R connected between the waist region and the foot region at left and right legs, and linear motion actuators 120L and 120R internally installed near intermediate sections of the leg rods (LR) 110L and 110R that expand and contract the leg rods (LR) 110L and 110R in a longitudinal direction thereof.

As shown in FIG. 1, both the left and right leg rods (LR) 110L and 110R are disposed on an inner side of both legs of the user. Accordingly, when the user wears the leg assist suit 100, the leg assist suit 100 does not receive an influence of a size in a widthwise direction of the body. In addition, the leg assist suit 100 is lightweight and compensates for the weight of the apparatus at a high rate.

Upper ends of the left and right leg rods (LR) 110L and 110R are connected to the anterior abdomen of the user via simple outfits (to be described below) configured as harnesses (to be described below). A host computer 140 configured to perform calculation processing such as drive control or the like of the linear motion actuators 120L and 120R, or a battery 141, which is a drive power supply, is mounted on the waist region (a harness).

A pelvis link (PL) is configured between connecting sections 111L and 111R of the upper ends of the leg rods (LR) 110L and 110R. Both the connecting sections 111L and 111R to the harnesses of the upper ends of the leg rods (LR) 110L and 110R have a two-axis-rotation degree of freedom of a hip roll joint (HRJ) and a hip pitch joint (HPJ), and can swing directions of foot tips of the legs (the leg rods (LR) 110L and 110R) by the two degrees of freedom forward, rearward, leftward and rightward. Both the hip roll joint HRJ and the hip pitch joint HPJ are rotational unactuated joints.

The leg rods (LR) 110L and 110R can transmit only one directional upward force generated by linear motion actuators 120L and 120R to the pelvis of the user via the harnesses.

In addition, lower ends of the left and right leg rods (LR) 110L and 110R are connected to the foot regions to be rotatable with respect to shoe center sections. Both connecting sections 112L and 112R of the lower ends of the leg rods (LR) 110L and 110R have a 3-axis-rotation degree of freedom of an ankle yaw joint (AYJ), an ankle roll joint (ARJ), and an ankle pitch joint (APJ), and postures of the foot regions of the legs can be freely determined by the 3 degrees of freedom. All of the ankle yaw joint AYJ, the ankle roll joint ARJ, the ankle pitch joint APJ are rotational unactuated joints.

In addition, touch sensors (footSW) 130L and 130R configured to detect a contact state between the sole of the foot and a road surface are mounted on left and right plantar regions.

Here, reviewing the degree of freedom configuration of the leg assist suit 100, each of the left and right legs has the 2-joint degree of freedom (HRJ and HPJ) of the connecting sections 111L and 111R of the upper ends of the leg rods (LR) 110L and 110R, the direct advance degree of freedom of the linear motion actuators 120L and 120R of the leg rods (LR) 110L and 110R and the 3-joint degree of freedom (AYJ, ARJ and APJ) of the connecting sections 112L and 112R of the lower ends of the leg rods (LR) 110L and 110R, i.e., each leg has a total 6 degrees of freedom. The 2-joint degree of freedom (HRJ and HPJ) of the connecting sections 111L and 111R swings directions of foot tips (the leg rods (LR) 110L and 110R) forward, rearward, leftward and rightward, the direct advance degree of freedom determines a distance to the foot region in a direction of a leg tip (a length of the leg rods (LR) 110L and 110R), and the 3-joint degree of freedom (AYJ, ARJ and APJ) determines a posture of the foot region.

In addition, while a degree of freedom configuration method of the leg assist suit 100 in which a redundant degree of freedom exceeding 6 degrees of freedom, for example, a hip yaw joint HYJ is further installed, or the like, is applied to each of connecting sections 111L and 111R of the legs is considered, control thereof may be unnecessarily difficult (for example, in swing of the direction of the foot tip forward, rearward, leftward and rightward, the 2 degrees of freedom of the hip roll joint HRJ and the hip pitch joint HPJ are sufficient, and the hip yaw joint HYJ is a redundant or unnecessary degree of freedom).

Figure 2:
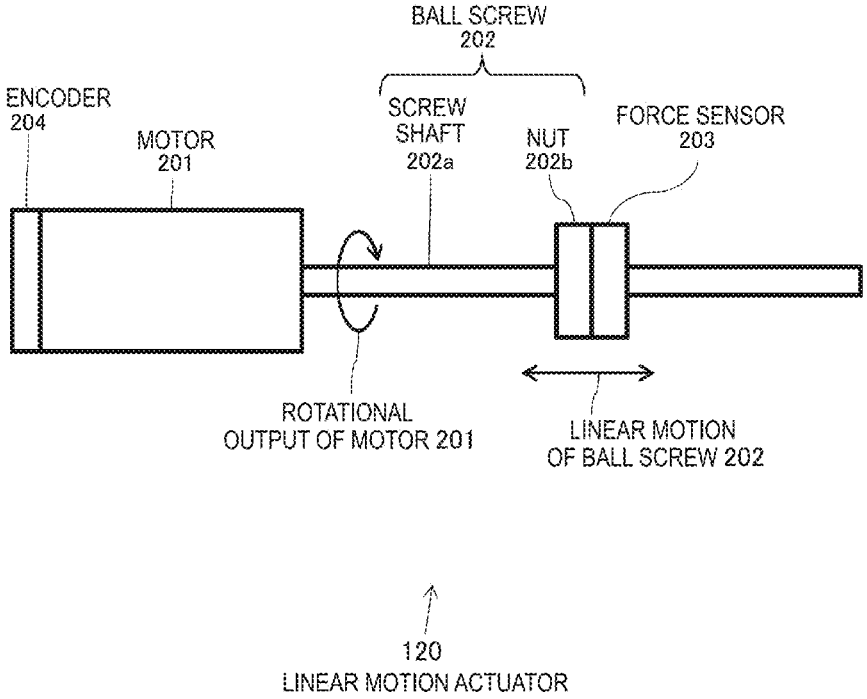
FIG. 2 is a view showing a configuration example of a linear motion actuator 120.

As described above, the left and right linear motion actuators 120L and 120R are internally installed near the intermediate sections of the leg rods (LR) 110L and 110R to expand and contract the leg rods (LR) 110L and 110R in the longitudinal direction. In FIG. 2, a configuration example of the linear motion actuator 120 is shown.

The linear motion actuator 120 includes a drive motor 201. An output shaft of the motor 201 is connected to a ball screw 202. The ball screw 202 is constituted by a screw shaft 202*a* and a nut 202*b* through which the screw shaft 202*a* passes. A screw groove (not shown) is formed in an inner circumference of the nut 202*b*, and the nut 202*b* moves along the screw shaft 202*a* when the screw shaft 202*a* is rotated. Accordingly, rotating movement of the motor 201 is converted into linear movement by the nut 202*b*, and as a result, movement in the longitudinal direction of the leg rod (LR) 110 is generated.

In addition, an encoder 204 configured to detect a rotating position is attached to a rotor of the motor 201. A rotation amount of the screw shaft 202*a* and a movement amount of the nut 202*b* have a proportional relation, and thus can be converted into a displacement amount to which the leg rod (LR) 110 is expanded and contracted in the longitudinal direction, based on an output value of the encoder 204.

In addition, a force sensor 203 is attached to the nut 202*b*. The force sensor 203 detects an external force applied when the nut 202*b* directly advances in the axial direction of the screw shaft 202*a*, in other words, when the leg rod (LR) 110 is expanded and contracted in the longitudinal direction.

Figure 18:
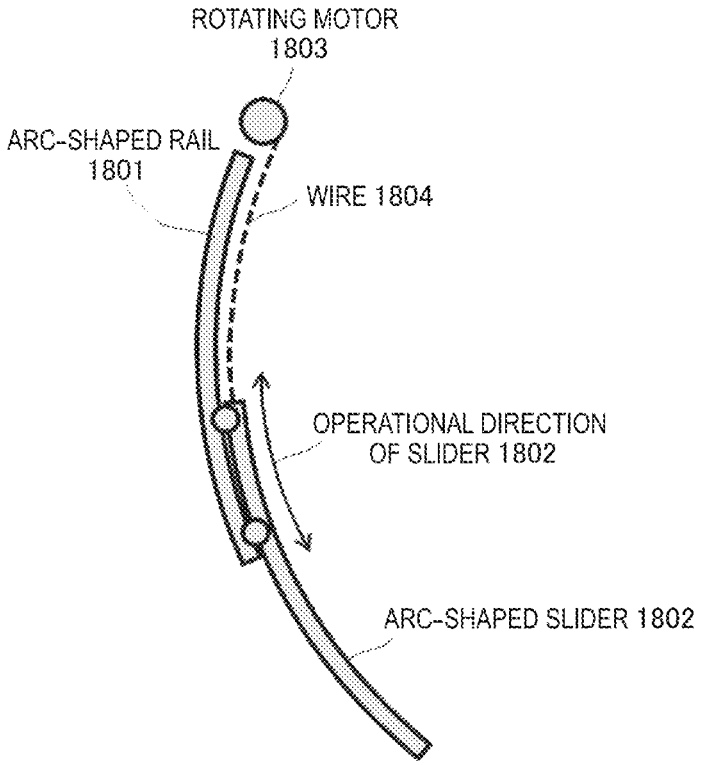
FIG. 18 is a view showing another configuration example of a linear motion actuator.
Figure 19:
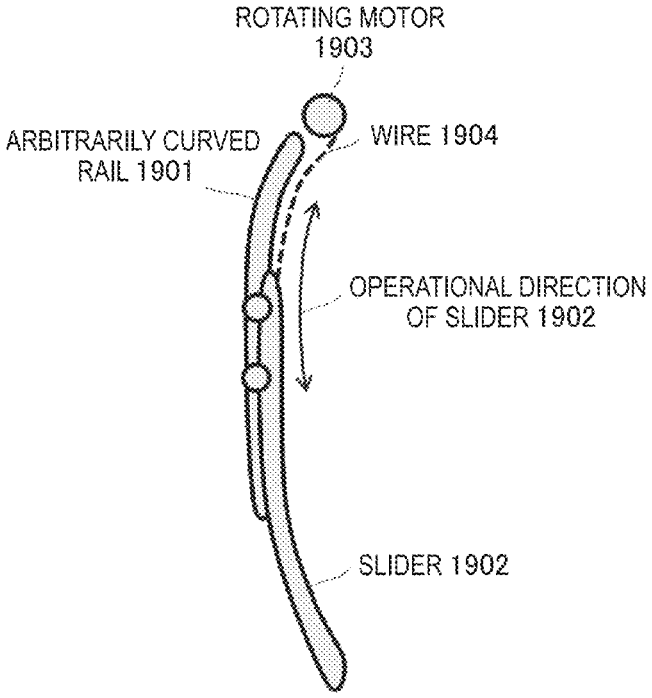
FIG. 19 is a view showing another configuration example of the linear motion actuator.

Further, in order to convert the rotating movement of the motor 201 into the linear movement, the linear motion actuator 120 may be configured using a mechanism other than a ball screw. In FIG. 18, another configuration example of the linear motion actuator is shown. An actuator 1800 shown in the drawing is constituted by a rail 1801, a slider 1802 movable on the rail 1801, a rotating motor 1803, and a wire 1804, without use of a ball screw. The slider 1802 is pulled by rotational driving of the rotating motor 1803 via the wire 1804. Then, the slider 1802 moves along the rail 1801 in upward and downward directions on the drawing. As the rail 1801 and the slider have substantially the same arc shape, a trajectory of the linear motion actuator exhibits an arc shape. In addition, as shown in FIG. 19, as a rail 1901 and a slider 1902 are formed in arbitrarily curved shapes, a linear motion actuator 1900 can be configured to exhibit an arbitrarily shaped trajectory. FIG. 19 is similar to FIG. 18 in that the slider 1902 is pulled by rotation driving of a rotating motor 1903 via a wire 1904. The linear motion actuator may not have a linear trajectory but may have an arbitrarily curved trajectory. As shown in FIG. 19, as the linear motion actuator is constituted by the rail 1901, the slider 1902 and the wire 1904, the linear motion actuator having an arbitrary curved trajectory can be realized.

Figure 3:
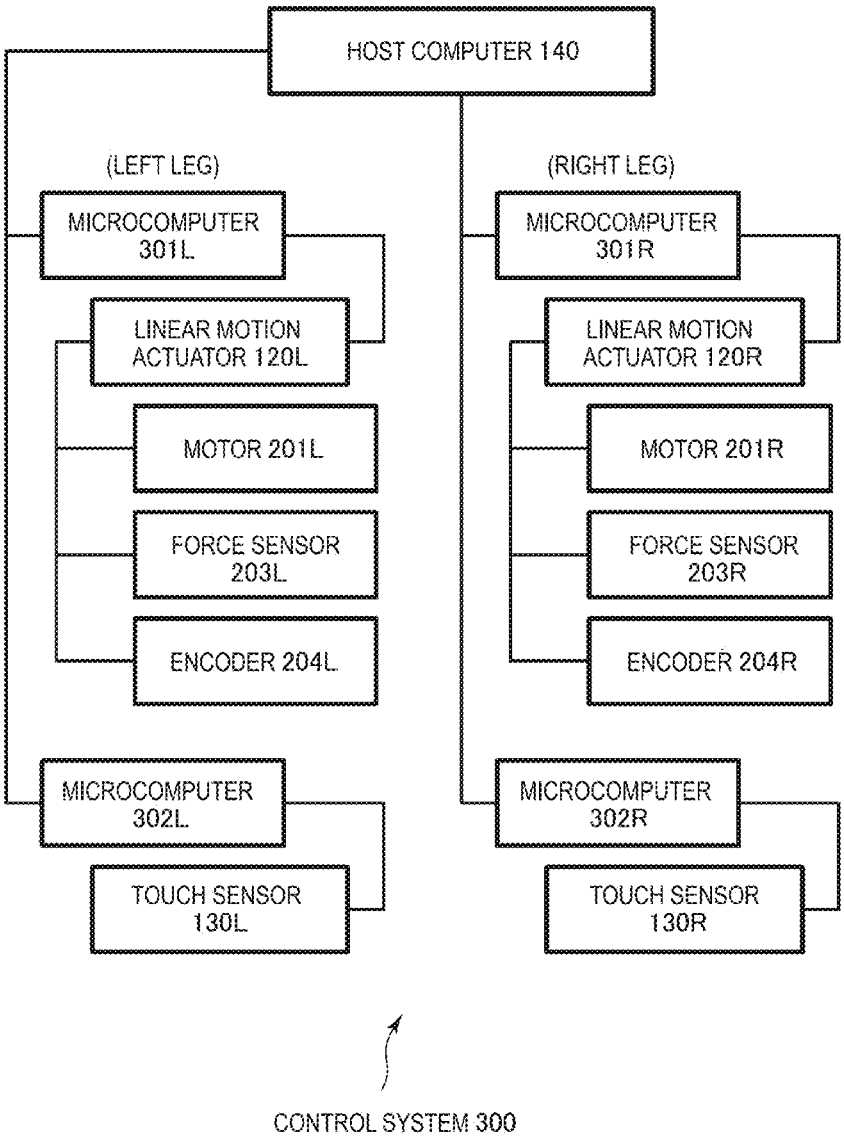
FIG. 3 is a view showing a configuration example of a control system 300 of the leg assist suit 100 constructed around a host computer 140.

FIG. 3 shows a configuration example of the control system 300 of the leg assist suit 100 constructed around the host computer 140.

Microcomputers 301L and 301R configured to perform communication with the host computer 140 are installed at the linear motion actuators 120L and 120R, respectively. The host computer 140 can read output values of the force sensors 203L and 203R and output values of the encoders 204L and 204R via the microcomputers 301L and 301R. In addition, the host computer 140 can apply control target values to drive circuits of the motor 201L and 201R via the microcomputers 301L and 301R.

The host computer 140 performs force controls of the linear motion actuators 120L and 120R using the output values of the force sensors 203L and 203R and the output values of the encoders 204L and 204R. Each of the linear motion actuators 120L and 120R has a cause that generates a large error such as a difficulty in modeling or identification, such as friction or inertia. On the other hand, in the embodiment, in order to realize an ideal joint unit (IJU) in the leg assist suit 100, the force control of each of the linear motion actuators 120L and 120R is performed. In driving of each of the linear motion actuators 120L and 120R, a control system that can instruct an output torque based on a numerical model (an ideal response model) to deal with causes of disturbance having difficulties in the above-mentioned modeling or identification is applied. Specifically, the motors 201L and 201R are controlled using values of the force sensors 203L and 203R and outputs of the encoders 204L and 204R, and a precise response is realized based on the numerical model (for example, see Japanese Patent No. 4715863). The motors 201L and 201R show a response of a precise second order system dominated by designated inertia and viscous resistance with respect to an order torque and an external torque. Accordingly, even when a small force is applied to the joint without interference with a motion of the joint due to friction or the like (of the ball screw 202 or the like), a variation in acceleration of each of the linear motion actuators 120L and 120R can be precisely exhibited. As a result, a force of supporting the exercise can be provided without application of resistance to the joint of the user wearing the leg assist suit 100.

In addition, microcomputers 302L and 302R configured to perform communication with the host computer 140 are installed at the touch sensors (footSW) 130L and 130R of the left and right plantar regions, respectively. The host computer 140 can read output values of the touch sensors (footSW) 130L and 130R via the microcomputers 302L and 302R.

The host computer 140 can determine whether each of the left and right legs is a stance leg or a swing leg based on a contact state between the left and right plantar regions and the road surface. Next, detailed description of the force control of the linear motion actuators 120L and 120R configured to perform the force control of the left and right linear motion actuators 120L and 120R in the host computer 140 according to a state in which the leg is either the stance leg or the swing leg will be provided below.

Figure 4:
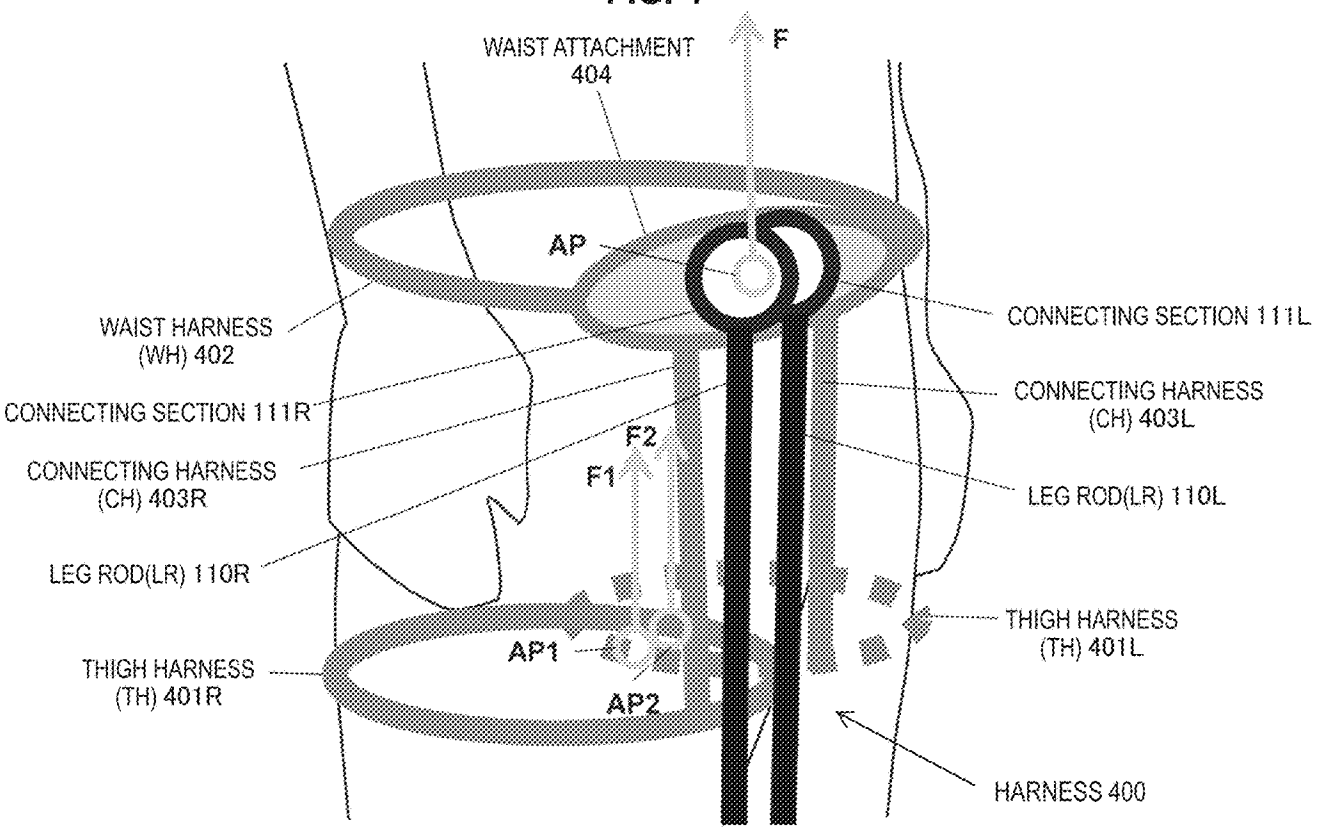
FIG. 4 is a view schematically showing a configuration of a harness 400 configured to fix the leg assist suit 100 to the waist region of a user.

FIG. 4 schematically shows a configuration of the harness 400, which is lightweight, as an example of an outfit configured to fix the leg assist suit 100 to the waist region of the user.

The harness 400 is configured to transmit an upward force applied from the left and right leg rods (LR) 110L and 110R to the pelvis of the user. Specifically, the harness 400 is constituted by left and right thigh harnesses (TH) 401L and 401R mounted on the left and right thighs of the user, a waist harness (WH) 402 mounted on the waist region of the user, and linear connecting harnesses (CH) 403L and 403R configured to connect the waist harness (WH) 402 to the thigh harnesses (TH) 401L and 401R.

Upper ends of the left and right leg rods (LR) 110L and 110R are attached to a front section of the waist harness (WH) 402 having an annular shape via the connecting sections 111L and 111R on a waist attachment (WA) 404. The waist attachment (WA) 404 is formed of a hard material, and integrated with the waist harness (WH) 402 with one touch. As the waist attachment (WA) 404 is removed from the waist harness (WH) 402, the left and right leg rods (LR) 110L and 110 are separated from the harness 400. Otherwise, the leg rods (LR) 110L and 110 may be configured to be detachably attached to the waist attachment (WA) 404.

In addition, the linear connecting harnesses (CH) 403L and 403R are also connected to a front section of the waist harness (WH) 402 via the waist attachment (WA) 404.

Here, when the leg rod (LR) 110L or 110R is expanded, a force F directed upward is applied to an acting point APPARATUS of the waist attachment (WA) 404. Then, the left and right thigh harnesses (TH) 401L and 401R are raised upward via the connecting harnesses (CH) 403L and 403R by the force F directed upward.

The waist attachment (WA) 404, i.e., the front section of the waist harness (WH) 402, is disposed near a center portion of the anterior abdomen of the user. When the left and right thigh harnesses (TH) 401L and 401R are raised upward via the connecting harnesses (CH) 403L and 403R, the left and right thigh harnesses (TH) 401L and 401R come in contact with the pelvis at the acting points AP1 and AP2, and forces F1 and F2 directed upward are applied to the pelvis. Accordingly, the upwardly directed force F applied to the acting point AP of the waist attachment (WA) 404 by expansion and contraction motions of the leg rods (LR) 110L and 110R are transmitted to the pelvis via the connecting harnesses (CH) 403L and 403R as the forces F1 and F2 applied to the acting points AP1 and AP2.

The front section of the annular waist harness (WH) 402 is disposed at the anterior abdomen of the user. Accordingly, the acting point of the force to the user wearing the leg assist suit 100 according to the embodiment is the anterior abdomen of the user.

Meanwhile, the acting point of the force is considered to be ideally set to the inside of the trunk, not the anterior abdomen of the user. However, in order to set the acting point of the force to the inside of the trunk of the user, a known mechanical mechanism such as a gimbal or an arc-shaped slider should be used in the assist suit (for example, see Japanese Patent Application Laid-open No. 2011-67227), and the weight of the apparatus is increased and the user may not easily sit while wearing it. A price or the like of the apparatus may also be increased. On the other hand, as shown in FIG. 4, the applicant has considered that, according to the configuration of the leg assist suit 100 using the anterior abdomen of the user as the acting point of the force, the apparatus is lightweight, the user can sit while wearing it, and the apparatus can be configured at a low cost.

Figure 5:
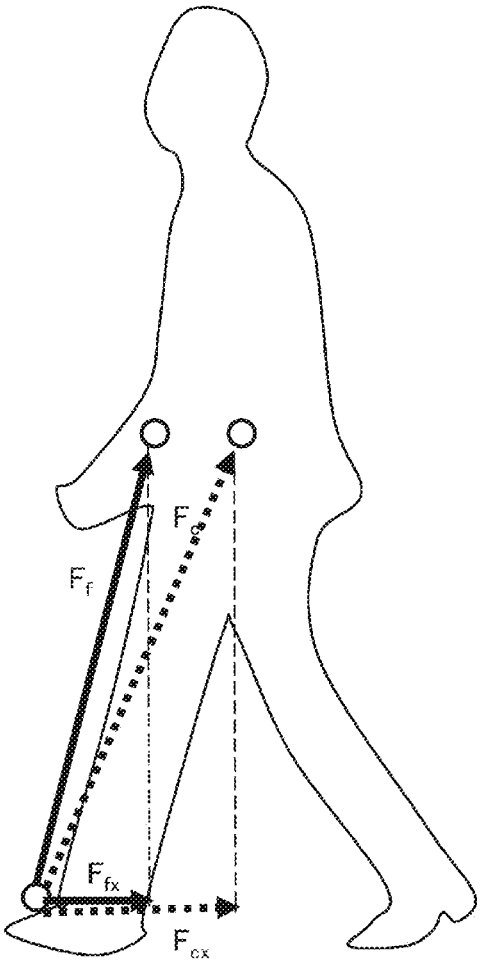
FIG. 5 is a view schematically showing an aspect in which a force is applied to a foot region when the anterior abdomen and the inside of the trunk of the user are used as acting points.

FIG. 5 schematically shows an aspect in which a force is applied from the foot region near the stance leg of the user during walking when the anterior abdomen and the inside of the trunk of the user are set as the acting point of the force. In the drawing, a force $F_f$ applied from the foot region to the anterior abdomen is shown by a solid arrow, and a force $F_c$ applied from the foot region to the inside of the trunk is shown by a dotted arrow. In addition, components of forces $F_{fx}$ and $F_{cx}$ in the forward and rearward directions of the force $F_c$ applied from the foot region to the inside of the trunk are shown in parallel to the force $F_f$ applied from the foot region to the anterior abdomen. As can be seen from the drawing, the force $F_{fx}$ is smaller than the force $F_{cx}$. Using the anterior abdomen of the user as the acting point of the force means that a marginal force applied to the body of the user in the forward and rearward directions may be small.

Accordingly, as described above and as shown in FIG. 4, using the anterior abdomen of the user as the acting point at which the force is applied from the leg assist suit 100 to the user makes it difficult to receive a force action in the forward and rearward directions during walking from the leg rods (LR) 110L and 110R, and smooth force support can be performed, in comparison with the case in which the inside of the trunk is used as the acting point.

The harness 400 shown in FIG. 4 may be configured such that the user can easily attach and detach the apparatus by installing, for example, a buckle (not shown) at the front section. In addition, a device constituted by the host computer 140, the battery 141, or the like, can be extremely easily mounted on the waist attachment (WA) 404. Accordingly, in comparison with the boarding type walk support apparatus (for example, see Japanese Patent No. 4641225), it will be appreciated that easy attachment and detachment of the leg assist suit 100 according to the embodiment is not hindered.

When the upward force F is applied to the waist attachment (WA) 404, the connecting harnesses (CH) 403L and 403R are expanded, and the thigh harnesses (TH) 401L and 401R are deformed. As a result, the force is applied to the pelvis at the acting points AP1 and AP2. Accordingly, discomfort applied to the user due to the mounting is reduced without necessity of strongly fastening the harness 400.

In addition, as a soft material or a pad (not shown) is disposed near the acting points AP1 and AP2 of the thigh harnesses (TH) 401L and 401R or buttocks of the user, a pressure applied to the user can be distributed and comfort can be further improved.

In the boarding type walk support apparatus (for example, see Japanese Patent No. 4641225), generally, a mechanism of a hip joint region is complicated, the weight of the apparatus is increased and a cost is increased, and the user may not sit while wearing it. On the other hand, the applicant has considered that the leg assist suit 100 according to the embodiment can totally improve practicability without the above-mentioned problems.

Figure 6:
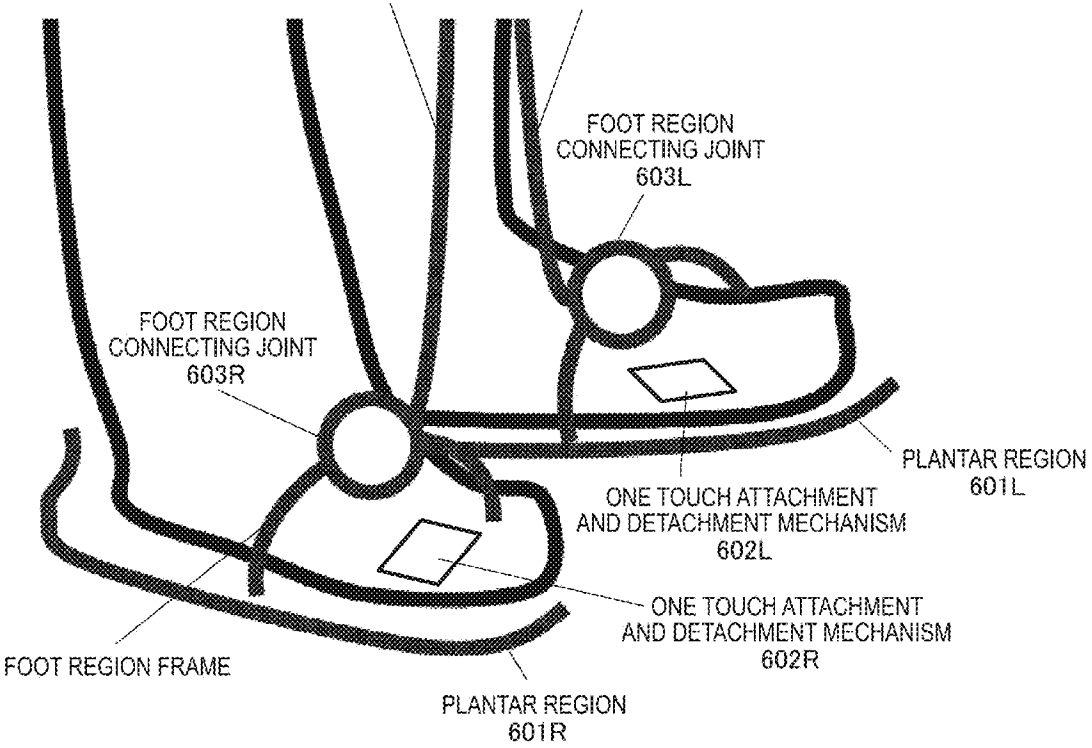
FIG. 6 is a view schematically showing a configuration in which the leg assist suit is attached to the foot region of the user.

FIG. 6 schematically shows a configuration in which the leg assist suit 100 is attached to the foot region of the user. As shown, left and right plantar regions 601L and 601R of the leg assist suit 100 are connected to shoes worn by the user via one touch attachment and detachment mechanisms 602L and 602R.

For example, clip systems (not shown) attached to a pedal of a vehicle or a ski plate of a ski boot and used can be applied to the one touch attachment and detachment mechanisms 602L and 602R.

The plantar regions 601L and 601R are connected to the lower ends of the leg rods (LR) 110L and 110R via foot region connecting joints 603L and 603R, respectively. The foot region connecting joints 603L and 603R have 3 rotational degrees of freedom of the ankle yaw joint (AYJ), the ankle roll joint (ARJ) and the ankle pitch joint (APJ). A rotational center (pivot) thereof is disposed near subhallucal region of the user in the forward and rearward directions and near a center of the sole in the widthwise direction. Even when the leg assist suit 100 applies a raising force of the swing leg by such axial disposition, an unpleasant moment when the user becomes bowlegged or bandy-legged may not be easily applied.

In addition, in the boarding type walk support apparatus (for example, see Japanese Patent No. 4641225), the pivot is disposed inside in the plantar widthwise direction. This is considered because the raising assist of the leg is not primarily assumed. In the configuration in which the pivot is disposed inside in the plantar widthwise direction other than the center, in reality, the unpleasant moment when the swing leg becomes bandy-legged is applied to the human body. Accordingly, from a general viewpoint, it is desirable that the pivots of the foot region connecting joints 603L and 603R be disposed near the center in the plantar widthwise direction.

The upper ends of the left and right leg rods (LR) 110L and 110R are connected to the waist attachment (WA) 404 (as described above). A two-axis free joint in the pitch direction and the roll direction is configured at the connecting sections 111L and 111R, and the leg rods (LR) 110L and 110R are freely directed in forward, rearward, leftward and rightward directions when seen from the pelvis.

The free joint in the left and right roll directions may be configured to be disposed at the center in the widthwise direction of the pelvis (preferably, to be concentric with the center) as much as possible. For this reason, this will be described with reference to FIGS. 8A and 8B together with FIGS. 7A and 7B.

Figure 7A:
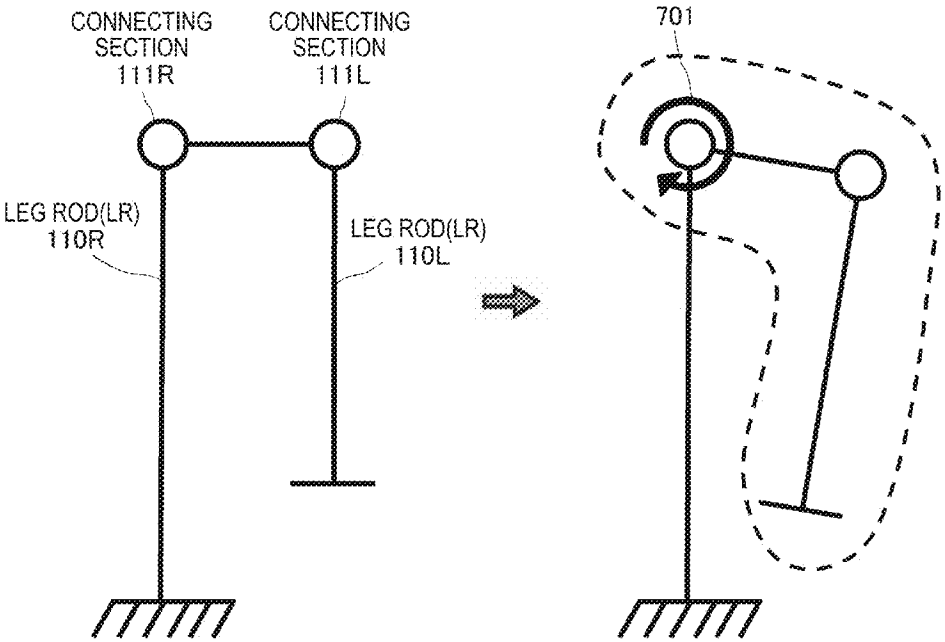
FIG. 7A is a view schematically showing an aspect in which a walking motion is supported by the leg assist suit 100 configured such that free hip joint roll axes of left and right legs are spaced a distance from each other.

FIG. 7A schematically shows an aspect in which a distance between free hip roll joints of the left and right legs is increased and a walking motion is supported by the leg assist suit 100. When the distance between the free hip roll joints of the left and right legs is increased, as shown on the right side of the same drawing, the weight of the swing leg side of the leg assist suit 100 is easily applied to the user (in the drawing, a moment generated by the weight is shown by an arrow 701).

Figure 7B:
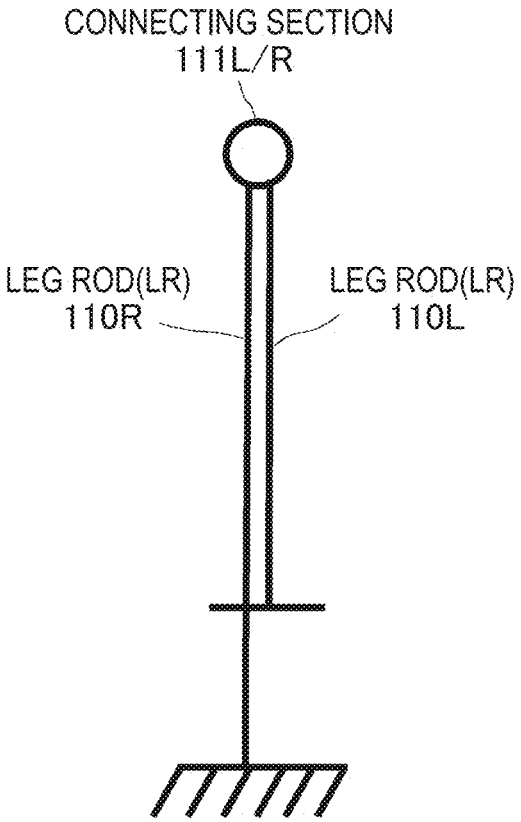
FIG. 7B is a view schematically showing an aspect in which a walking motion is supported by the leg assist suit 100 configured such that the free hip joint roll axes of the left and right legs are concentrated at one point.

Meanwhile, FIG. 7B schematically shows an aspect in which a walking motion is supported by the leg assist suit 100 such that the left and right hip roll joints are concentrated at one point. In this case, falling of the pelvis link may not be easily generated, and the weight of the swing leg of the leg assist suit 100 may not be easily applied to the user.

Figure 8A:
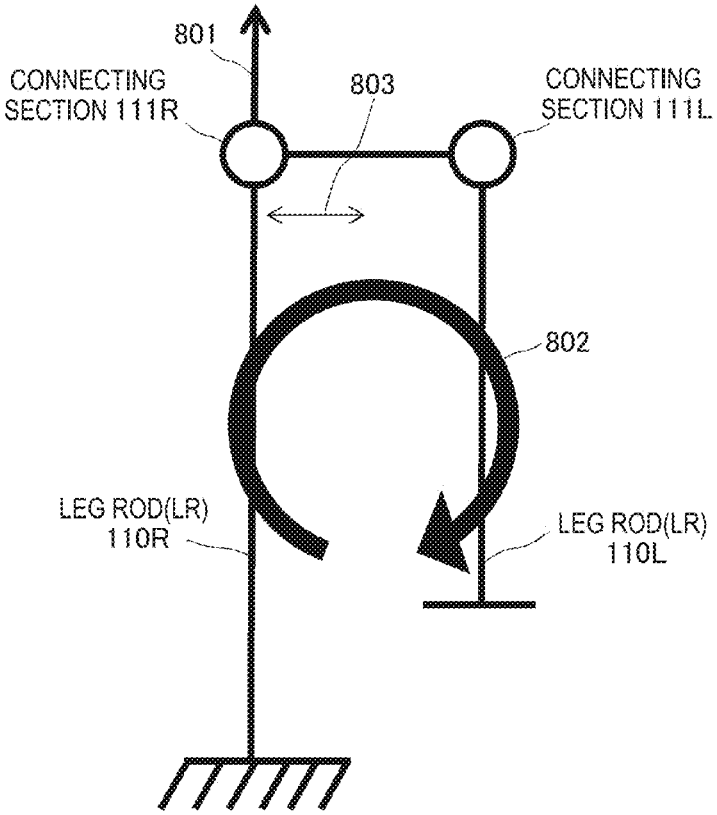
FIG. 8A is a view schematically showing a lateral reverse moment around a roll axis by an assist force received from a stance leg during a walking motion when the free hip joint roll axes of the left and right legs are spaced a distance from each other.
Figure 8B:
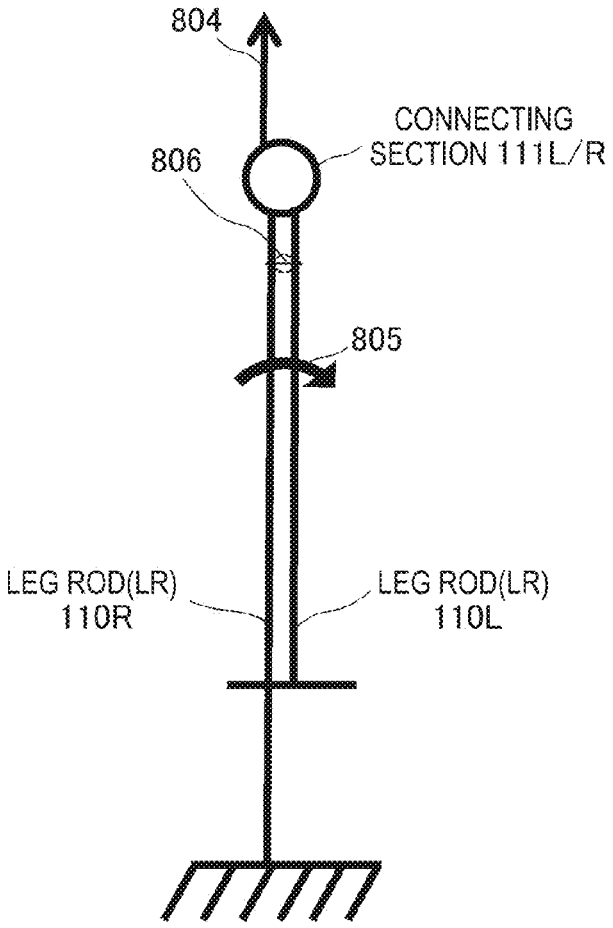
FIG. 8B is a view schematically showing a lateral reverse moment around the roll axis by the assist force received from the stance leg during the walking motion when the free hip joint roll axes of the left and right legs are concentrated at one point.

In addition, FIGS. 8A and 8B schematically show a lateral reverse moment about a roll axis by an assist force received from the stance leg during the walking motion when the distance between the free hip roll joints of the left and right legs is increased and when the free hip roll joints are concentrated at one point.

In FIG. 8A, in the leg assist suit 100 configured such that the distance between the free hip roll joints of the left and right legs is increased, a lateral reverse moment about a roll axis by an assist force 801 received from the stance leg during the walking motion is shown by an arrow 802. When the distance between the free hip roll joints of the left and right legs is increased, since a moment arm 803 when seen from a center of the body of the user is increased, a lateral reverse moment 802 is easily increased and easily applied to the user.

Meanwhile, in FIG. 8B, in the leg assist suit 100 configured such that the left and right hip roll joints are concentrated at one point, a lateral reverse moment about a roll axis by an assist force 804 received from the stance leg during the walking motion is shown by an arrow 805. When the distance between the free hip roll joints of the left and right legs is reduced, since a moment arm 806 when seen from the center of the body of the user is reduced, a lateral reverse moment 805 can be suppressed to a low level and may not be easily applied to the user.

Comparing FIGS. 8A and 8B, as a connecting point between the leg rods (LR) 110L and 110R and the waist attachment (WA) 404 is disposed near the center in the widthwise direction of the pelvis (i.e., as shown in FIG. 8B), the lateral reverse moment can be suppressed to a low level at each stage.

In addition, when the leg assist suit 100 is configured to concentrate the left and right hip roll joints at one point, the number of parts in the widthwise direction of the body is reduced, the weight is reduced, the cost is reduced, and conformity of the human body to the size in the widthwise direction is reduced.

As described above, the leg rods (LR) 110L and 110R are configured to be freely expanded and contracted in the longitudinal direction by a mechanism of the ball screw 202 (of course, they may be configured to be freely expanded and contracted in the longitudinal direction using a mechanism other than the ball screw). Here, a method of assisting in the exercise such as bending and stretching of the leg portion using the motion in the longitudinal direction of the linear motion actuator 120 like the leg assist suit 100 according to the embodiment is compared with a method of assisting in an exercise by driving a rotational joint of an intermediate section of a leg such as a knee joint or the like.

Figure 9A:
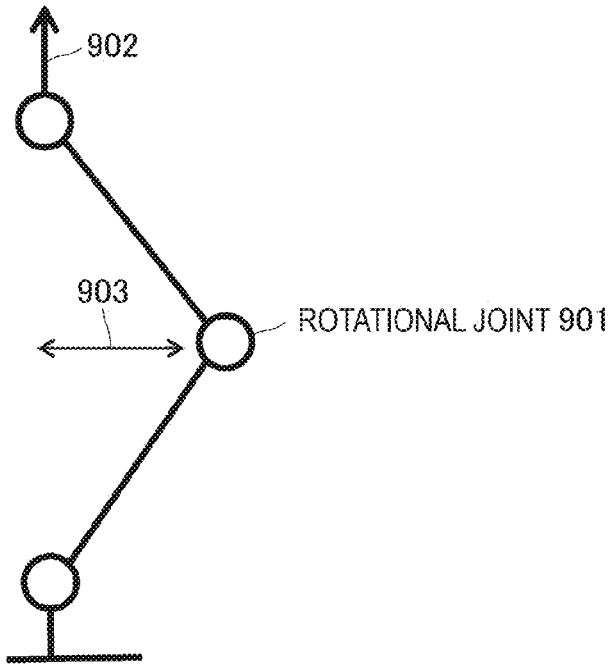
FIG. 9A is a view schematically showing a configuration of the leg assist suit, in which a rotational joint 901 is disposed in an intermediate section to generate expansion and contraction forces in upward and downward directions to a user's legs.

FIG. 9A schematically shows a configuration of the leg assist suit at which a rotational joint 901 is disposed at the intermediate section of the leg such as the knee or the like to generate expansion and contraction forces in upward and downward directions from the leg of the user. In this case, in a manipulation space in the upward and downward directions of the upper end of the leg region, a manipulability level is largely varied by the posture (while a generating direction of a force by rotation of the rotational joint is shown by an arrow 902 in the drawing, the manipulability level is largely varied). In addition, in a peculiar posture at which the knee is expanded, the manipulability level is reduced and an upward force may not be applied. In other words, in order to effectively generate the upward force to enable upward and downward movement without falling into the peculiar posture, the knee should be sufficiently bent. However, in the posture in which the knee is bent, as can be seen from FIG. 9A, the leg assist suit has an increased overhang amount 903 in the forward and rearward directions, which causes deterioration of an appearance.

Figure 9B:
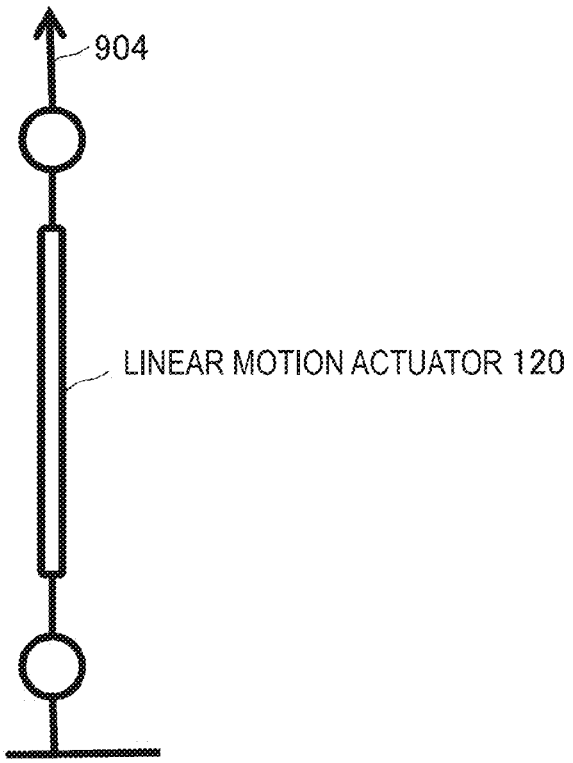
FIG. 9B is a view schematically showing a configuration of the leg assist suit configured to generate expansion and contraction forces in upward and downward directions to the user's legs in a linear motion type.

Meanwhile, in FIG. 9B, like the embodiment, a configuration of the linear motion type leg assist suit 100 configured to generate expansion and contraction forces in upward and downward directions to the leg of the user is shown. As shown, while an upward and downward force 904 is generated by a motion of the linear motion actuator 120, there is no peculiar posture. Accordingly, when the upward and downward movement is performed, since the manipulability level is constant without dependence on a direct motion joint value, an appropriate force support can be performed at all times. In addition, in order to effectively generate the upward force, the knee may not be bent. Accordingly, when the upward and downward movement is performed, the leg assist suit does not expand in the forward and rearward directions, improving the appearance.

Figure 10:
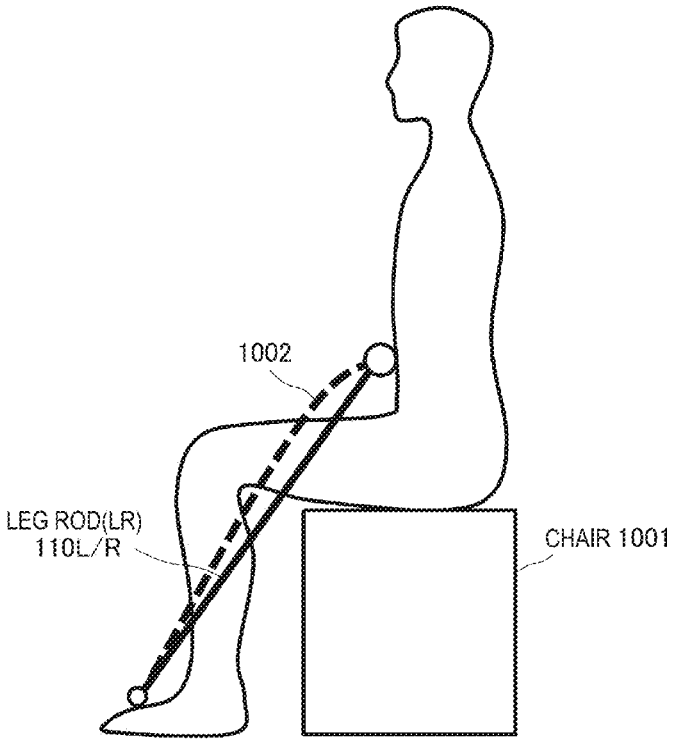
FIG. 10 is a view schematically showing a state in which a user wearing the leg assist suit 100 sits.

Next, the interference between the leg rods (LR) 110L and 1100R and the chair when sitting in the leg assist suit 100 will be described. FIG. 10 schematically shows a state in which the user wearing the leg assist suit 100 according to the embodiment sits. While the interference between the leg rods (LR) 110L and 110R and the chair upon sitting may occur, as can be seen from FIG. 10, the interference with a chair 1001 does not easily occur. In order to maintain a margin, as shown by dotted lines 1002 in the drawing, portions of the leg rods (LR) 110L and 110R may be slightly curved to protrude toward the front section of the body of the user to provide a non-linear configuration, rather than the straight shape.

Figure 11:
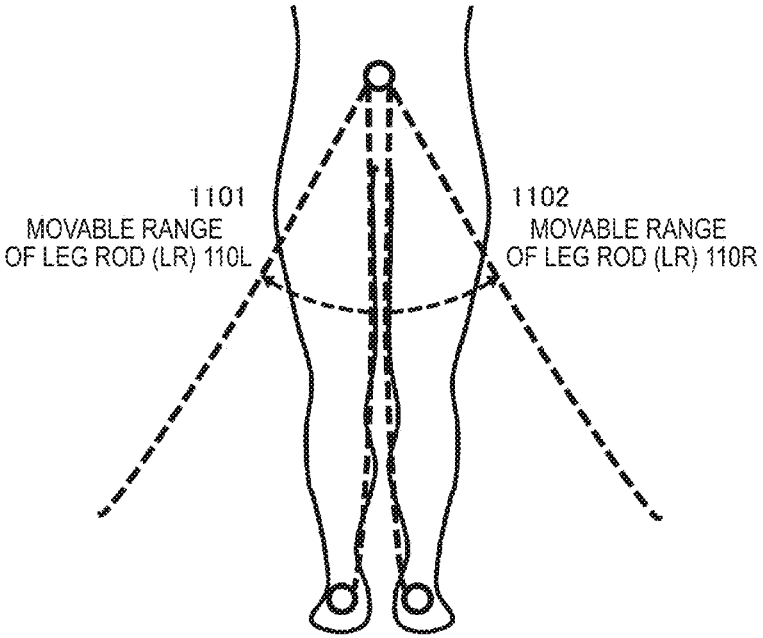
FIG. 11 is a view showing a movable range in which leg rods (LR) 110L and 110R do not interfere with each other.

In addition, since both the left and right leg rods (LR) 110L and 110R are disposed on the inner sides of the legs, the interference between the leg rods (LR) 110L and 110R may occur. As described above, the left and right leg rods (LR) 110L and 110R are attached to the front section of the waist harness (WH) 402 to be swingable forward, rearward, leftward and rightward via the connecting sections 111L and 111R having the two-axis-rotation degree of freedom of the hip roll joint (HRJ) and the hip pitch joint (HPJ). As shown in FIG. 11, the leg rods (LR) 110L and 110R may have a movable range not to interfere with each other. For example, a mechanical limit (not shown) configured to restrict a movable range of the hip roll joint (HRJ) in each of the connecting sections 111L and 111R can be disposed, and as shown by reference numerals 1101 and 1102 in FIG. 11, movable ranges of the leg rods (LR) 110L and 110R can be set.

Next, a support side of the force by the leg assist suit 100 will be described. Motions of the leg region such as walking or running, ascending and descending of stairs, or the like, of a human are realized by alternating the left and right legs as the stance leg and the swing leg.

Figure 12:
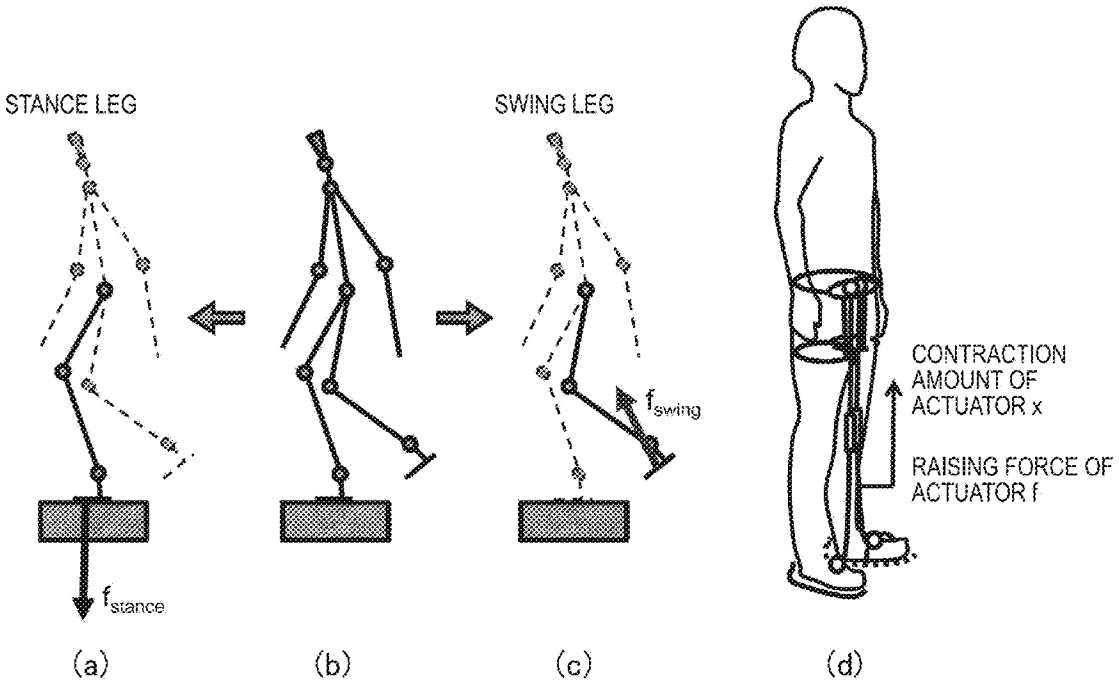
FIG. 12 is a view schematically showing a motion of a leg of the user and a motion of the leg assist suit 100.

The leg of the stance leg side performs a motion of expanding a knee pitch joint and raising the weight of the user, for example, when ascending stairs. When the knee pitch joint is bent, the user may not easily raise the weight. Here, the leg assist suit 100 may generate a pressing force $F_{stance}$ at the stance leg side that supports the weight according to a flexure amount $\theta_{KPJ}$ of the knee to the linear motion actuator 120 of the stance leg side, and apply the pressing force to the user (see FIG. 12(*a*)).

In addition, the leg of the swing leg side bends the hip pitch joint to bend the thigh with respect to the trunk, and performs a motion of raising the swing leg. While the swing leg is raised as the hip joint is bent, if the raising of the swing leg is insufficient, the foot tip of the swing leg may collide with the ground. The leg assist suit 100 may generate a raising force $f_{swing}$ according to a flexure amount $\theta_{HPJ}$ of the hip joint at the swing leg side to the linear motion actuator 120 of the swing leg side, and apply the raising force to the user (see FIG. 12(*c*)).

The flexure amount $\theta_{HPJ}$ of the hip pitch joint of the swing leg side can approximate a position $x_{swing}$ of the linear motion actuator 120 of the same leg. Similarly, the flexure amount $\theta_{KPJ}$ of the knee pitch joint of the stance leg side can approximate a position $x_{stance}$ of the linear motion actuator 120 of the same leg (see FIG. 12(*d*)). Of course, an encoder may be attached to the hip pitch joint or the knee pitch joint, and may be configured to directly measure the flexure amounts $\theta_{HPJ}$ and $\theta_{KPJ}$ of the joints.

The leg assist suit 100 may apply a force for self-weight compensation together with the stance leg and the swing leg when the force support is performed. Provided that the self-weight of the leg assist suit 100 of the stance leg is set as $m_{stance}$, the force for self-weight compensation is $-m_{stance}g$. In addition, provided that the self-weight of the leg assist suit 100 of the swing leg is set as $m_{swing}$, the force for self-weight compensation is $m_{swing}g$. Here, the raising direction is set as a positive direction, and the lowering direction is set as a negative direction.

Further, since the force necessary for raising the swing leg is also applied to the stance leg side, a force $F_{swing}$ for raising the swing leg is not applied from the waist attachment (WA) 404 to the user.

Accordingly, the control sides of the support forces $f_{swing}$ and $f_{stance}$ applied to the swing leg and the stance leg are represented by the following equations (1) and (2), respectively. However, in each equation, $K_{p1}$ and $K_{p2}$ have positive gains.

$$\text{(Swing leg side)} f_{swing} = K_{p2} x_{swing} + m_{swing} g \quad (1)$$

$$\text{(Stance leg side)} f_{stance} = -K_{p1} x_{stance} - m_{stance} g - f_{swing} \quad (2)$$

The support forces $f_{swing}$ and $f_{stance}$ are forces of the linear motion actuator 120 of the swing leg side and the stance leg side. Determination of the stance leg and the swing leg can be performed based on output values of the touch sensors 130L and 130R installed at both of left and right foot regions (as described above). As represented by the above-mentioned equation (2), since a force $-f_{swing}$ for applying the swing leg raising force to the user should be added to the support force $f_{stance}$ of the stance leg side, first, the support forces $f_{swing}$ and $f_{stance}$ are calculated in sequence of the swing leg and then the stance leg.

Figure 13:
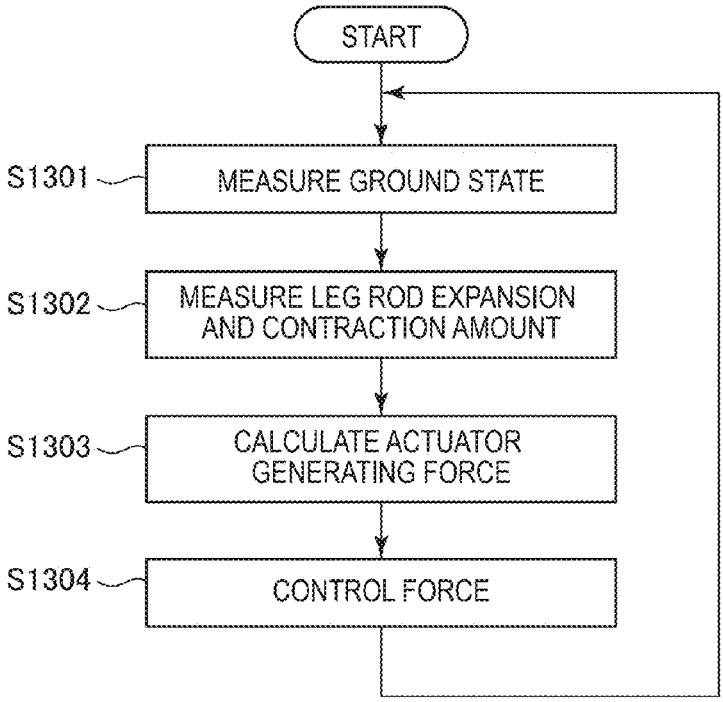
FIG. 13 is a flowchart showing a processing sequence for controlling a motion of the leg assist suit 100.

FIG. 13 shows a processing sequence for controlling a motion of the leg assist suit 100 according to the embodiment as a flowchart. The processing sequence can be realized in a manner in which, for example, the host computer 140 performs a predetermined program code.

First, the host computer 140 reads the output values of the touch sensors (footSW) 130L and 130R via the microcomputers 302L and 302R and determines a ground state of both of the left and right feet (step S1301). The leg determined as the grounded leg is referred to as the stance leg (stance), and the leg determined as the non-grounded leg is referred to as the swing leg (swing).

Next, the host computer 140 reads the output values of the encoders 204L and 204R of the linear motion actuators 120L and 120R via the microcomputers 301L and 301R, and measures expansion and contraction amounts x of the left and right leg rods (LR) 110L and 110R (step S1302). The expansion and contraction amount of the stance leg is referred to as $x_{stance}$, and the expansion and contraction amount of the swing leg side is referred to as $x_{swing}$.

In addition, the host computer 140 reads the output values of the force sensors 203L and 203R of the linear motion actuators 120L and 120R via the microcomputers 301L and 301R.

Next, the host computer 140 calculates target values of the generating forces of the linear motion actuators 120L and 120R as $f_{swing}$ and $f_{stance}$ in sequence of the swing leg and the stance leg based on the control sides represented by the above-mentioned equations (1) and (2) (step S1303).

Then, the host computer 140 transmits the generating force target values $f_{swing}$ and $f_{stance}$ calculated in step S1303 to a drive circuit of the motor 201L and 201R via the microcomputers 301L and 301R, and performs the force control based on the output values of the force sensors 203L and 203R of the linear motion actuators 120L and 120R (step S1304).

The host computer 140 may repeatedly perform the above-mentioned control loops S1301 to S1304 at a control period, for example, 10 milliseconds.

While the leg assist suit 100 shown in FIG. 1 or 4 is configured to mount the annular harness to the thigh (TH) and the waist region (WH) of the user, the technology of the present disclosure is not limited to a fixing method to the body of the user.

Figure 14:
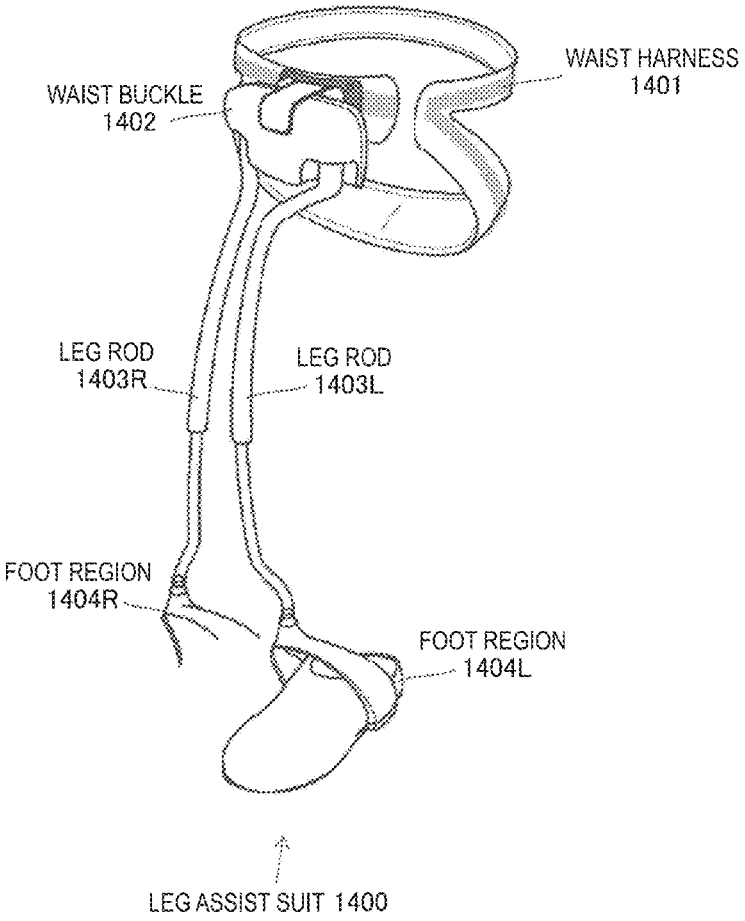
FIG. 14 is a view showing another configuration example of a leg assist suit 1400.

FIG. 14 shows another configuration example of a leg assist suit 1400. The leg assist suit 1400 shown in the drawing is constituted by a waist harness 1401, a waist buckle 1402, left and right leg rods 1403L and 1403R, and left and right foot regions 1404L and 1404R. Linear motion actuators (not shown) configured to perform expansion and contraction in the longitudinal direction are internally installed near intermediate sections of the leg rods 1403L and 1403R. In addition, while the legs of the user are not shown in the drawing, the left and right leg rods (LR) 1403L and 1403R are disposed on the inner sides of the legs of the user. Accordingly, when the user wears the leg assist suit 100, there is no influence on the size in the widthwise direction of the body.

The waist harness 1401 is configured to annularly cover the buttocks and the waist region of the user. According to the above-mentioned configuration, a force applied from the upper end of the leg rod (LR) 110L or 110R to the anterior abdomen can be applied to the buttocks in the drawing. That is, the support force can be distributed, and pain or pressure to the user can be reduced.

Figure 15:
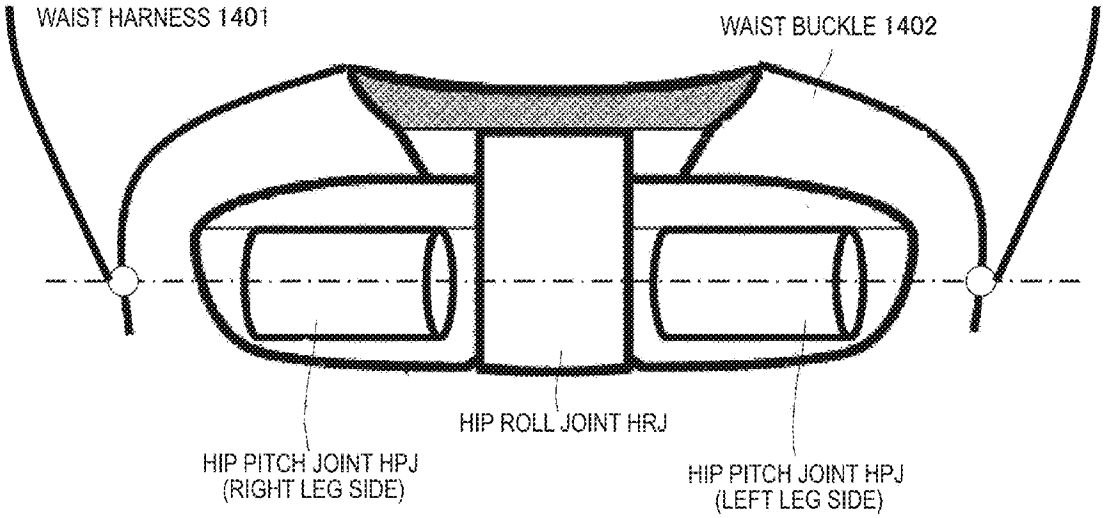
FIG. 15 is a view schematically showing an aspect in which a waist buckle 1402 is seen from above.

The upper ends of the leg rods (LR) 1403L and 1403R are attached to the waist harness 1401 via the waist buckle 1402. FIG. 15 schematically shows an aspect of the waist buckle 1402 when seen from above. As shown, the waist buckle 1402 connects the upper end of the leg rods (LR) 1403L and 1403R with the two-axis-rotation degree of freedom of the hip roll joint (HRJ) and the hip pitch joint (HPJ). Both the hip roll joint HRJ and the hip pitch joint HPJ are rotational unactuated joints. The leg rods (LR) 1403L and 1403R can transmit only one directional upward force generated by the linear motion actuator to the pelvis of the user via the waist buckle 1402 and the waist harness 1401.

In addition, in order to reduce a rotational moment of the waist buckle 1402, as shown in FIG. 15, a connecting point of the waist harness 1401 and the waist buckle 1402 may be disposed near an axial line of the hip pitch joint HPJ.

Figure 16:
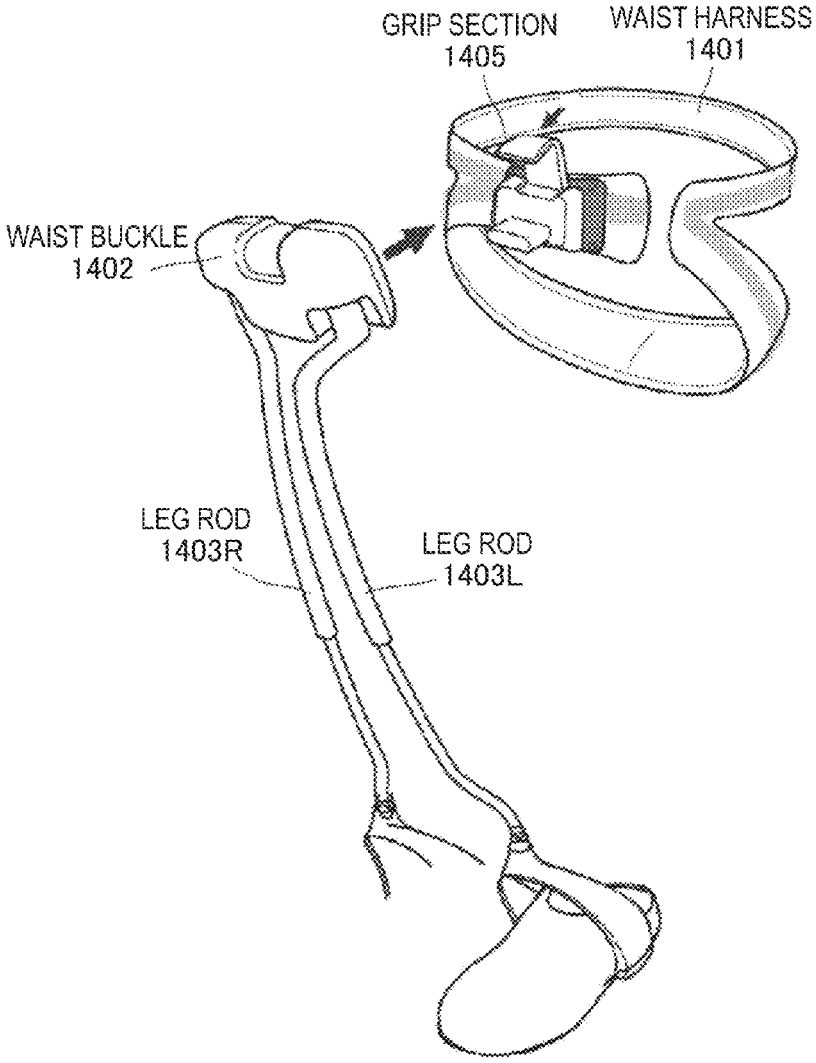
FIG. 16 is a view showing an aspect in which the waist buckle 1402 is mounted on a waist harness 1401.

FIG. 16 shows an aspect in which the waist buckle 1402 is mounted on the waist harness 1401. As shown, the leg rods 1403L and 1403R can be attached to or detached from left and right waist attachments 1401 together with the waist buckle 1402 by an opening/closing manipulation of one grip section 1405, increasing ease of attachment/detachment. As a pair of claws that constitute the grip section 1405 are manipulated in a direction shown by an arrow in the drawing, the waist buckle 1402 can be fixed to the waist harness 1401. While detailed illustration is omitted, as the waist buckle 1402 is mounted on the waist harness 1401, electrical connection is also simultaneously performed.

The waist buckle 1402 is attached to the waist harness 1401 around the center of the anterior abdomen of the user. An upward force is applied to the waist buckle 1402 by the expansion and contraction motion of the leg rods (LR) 1403L and 1403R, and transmitted to the pelvis via the waist harness 1401.

Figure 17:
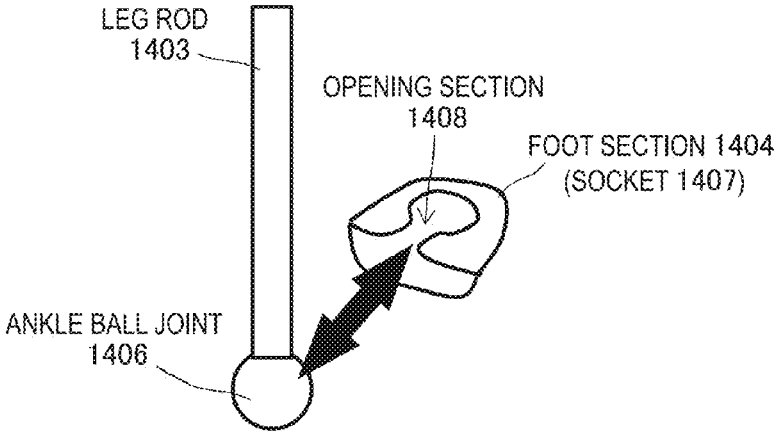
FIG. 17 is a view showing an aspect in which a lower end of a leg rod (LR) 1403 is connected to a foot region 1404.

FIG. 17 shows an aspect in which the lower end of the leg rod (LR) 1403 is connected to the foot region 1404. The lower end of the leg rod (LR) 1403 constitutes an ankle ball joint 1406. In addition, the foot region 1404 includes a socket 1407 configured to accommodate the ankle ball joint 1406. An opening section 1408 through which the leg rod (LR) 1403 is inserted is formed in an upper surface of the socket 1407. As shown by an arrow in the drawing, as the ankle ball joint 1406 is slid into/from the socket 1407, the leg rod (LR) 1403 can be easily connected to or easily separated from the foot region 1404.

In a state in which the ankle ball joint 1406 is inserted into the socket 1407 and the lower end of the leg rod (LR) 1403 is attached to the foot region 1404, the three-axis-rotation degree of freedom of the ankle yaw joint (AYJ), the ankle roll joint (ARJ) and the ankle pitch joint (APJ) is provided, and the posture of the foot region of each leg can be freely determined by the three degrees of freedom. All of the ankle yaw joint AYJ, the ankle roll joint ARJ and the ankle pitch joint APJ are rotational unactuated joints.

It will be sufficiently apparent from FIGS. 16 and 17 that the leg assist suit 1400 can enable easy separation of the left and right leg rods (LR) 1403L and 1403R from the waist harness 1401 and the foot regions 1404L and 1404R.

It should be understood by those skilled in the art that various modifications, combinations, sub-combinations and alterations may occur depending on design requirements and other factors insofar as they are within the scope of the appended claims or the equivalents thereof.

Additionally, the present technology may also be configured as below.

(1) An exercise support apparatus including:

a leg rod connected to a waist region and a foot region of a user and including a linear motion actuator;

a waist connecting section configured to connect one end of the leg rod to the waist region; and a foot region connecting section configured to connect the other end of the leg rod to the foot region.

(2) The exercise support apparatus according to (1), including the leg rod of each movable leg of the user.

(3) The exercise support apparatus according to (1), wherein the linear motion actuator is operated to expand and contract the leg rod in a longitudinal direction thereof.

(4) The exercise support apparatus according to (1), wherein the waist connecting section and the foot region connecting section are connected to the one end and the other end such that the leg rods are disposed inside both left and right legs.

(5) The exercise support apparatus according to (1), further including an outfit worn by the user at a trunk and having the waist connecting section.

(6) The exercise support apparatus according to (5), wherein the outfit is connected to the one end of the leg rod via the waist connecting section in a vicinity of an anterior abdomen of the user.

(7) The exercise support apparatus according to (1) or (5), wherein the waist connecting section is connected to the one end of the leg rod with the 2 rotational degrees of freedom.

(8) The exercise support apparatus according to (5), wherein the outfit transmits one direction upward force generated by the linear motion actuator to a pelvis of the user.

(9) The exercise support apparatus according to (5), wherein the leg rod is detachable from the outfit at the one end.

(10) The exercise support apparatus according to (1), wherein the foot region connecting section is connected to the other end of the leg rod with the 3 rotational degrees of freedom.

(11) The exercise support apparatus according to (5), wherein the outfit has a thigh harness annularly surrounding a thigh of the leg of the user, a waist harness annularly surrounding the waist region of the user and connected to the one end of the leg rod, and a substantially linear connecting harness configured to connect the waist harness and the thigh harness.

(12) The exercise support apparatus according to (11), wherein the connecting harness is connected to the vicinity of the front section of the waist harness.

(13) The exercise support apparatus according to (11), wherein, when the linear motion actuator is expanded and the waist harness is raised upward, as the thigh harness is raised via the connecting harness, an upward force is transmitted to the pelvis of the user.

(14) The exercise support apparatus according to (1), further including a plantar region connected to a shoe worn by the user via a one touch attachment and detachment mechanism.

(15) The exercise support apparatus according to (1), further including a plantar region configured to connect the foot region connecting section having 3 rotational degrees of freedom such that a rotational center of the foot region connecting section is disposed in the vicinity of a subhallucal region of the foot region of the user in forward and rearward directions and in the vicinity of a center of the plantar of the user in a widthwise direction thereof.

(16). The exercise support apparatus according to (1), wherein the waist connecting section connects to the one end of the leg rod in the vicinity of a center in the widthwise direction of the pelvis of the user.

(17) The exercise support apparatus according to (16), wherein the leg rod is installed at each of the left and right legs of the user, and wherein the waist connecting sections of the left and right leg rods are disposed to be concentrated at one point.

(18) The exercise support apparatus according to (1), wherein the leg rod has a curved section curved toward a front section of the body of the user.

(19) The exercise support apparatus according to (1), wherein the leg rod is installed at each of the left and right legs of the user, and wherein the waist connecting section restricts a movable range about hip roll joints of the left and right leg rods.

(20) The exercise support apparatus according to (1), further including a control part configured to control a motion of the linear motion actuator.

(21) The exercise support apparatus according to (20), further including a force sensor configured to detect an external force applied to the linear motion actuator, wherein the control part force-controls the linear motion actuator based on an output value of the force sensor.

(22) The exercise support apparatus according to (20), further including a ground sensor configured to detect a ground state of the sole of the foot region, wherein the control part controls a motion of the linear motion actuator based on an output value of the ground sensor.

(23) The exercise support apparatus according to (20), further including a control part configured to force-control the linear motion actuator such that a pressing force $F_{stance}$ is applied to support a weight according to the flexure amount $\theta_{KPJ}$ of a knee of the user in the leg rod of a stance leg side, and such that a raising force $f_{swing}$ is applied according to the flexure amount $\theta_{HPJ}$ of the hip joint of the user in the leg rod of the swing leg side.

(24) The exercise support apparatus according to (23), further including an encoder configured to detect a position of the linear motion actuator, wherein the control part approximates a flexure amount $\theta_{KPJ}$ of the knee of the user and the flexure amount $\theta_{KPJ}$ of the knee at the position of the linear motion actuator.

(25) The exercise support apparatus according to (23), wherein the control part force-controls the linear motion actuator in consideration of a force for self-weight compensation to the pressing force $F_{stance}$ in the leg rod of the stance leg side and the raising force $f_{swing}$ in the leg rod of the swing leg side.

(26) The exercise support apparatus according to (25), wherein the control part force-controls the linear motion actuator so that the raising force $f_{swing}$ for the leg rod of the swing leg side is not applied to the leg rod of the stance leg side.

(27) An exercise support method of supporting an exercise of a user wearing the exercise support apparatus according to (1), the method including:

determining a ground state of the foot region;

force-controlling the linear motion actuator to apply a raising force $f_{swing}$ according to a flexure amount $\theta_{HPJ}$ of a hip joint of the user in the leg rod of a swing leg side; and force-controlling the linear motion actuator such that a pressing force $F_{stance}$ is applied to support a weight according to the flexure amount $\theta_{KPJ}$ of the knee of the user in the leg rod of a stance leg side.

(28) The exercise support method according to (27), wherein, in the first and second control steps, the linear motion actuator is force-controlled in consideration of a force for self-weight compensation of the apparatus of the swing leg side and the stance leg side.

(29) The exercise support method according to (28), wherein, in the second control step, in the leg rod of the stance leg side, the linear motion actuator is force-controlled in further consideration of the fact that the raising force $f_{swing}$ is not applied to the leg rod of the swing leg side.

(30) A computer-readable computer program, which supports an exercise of a user wearing the exercise support apparatus according to (1), wherein a computer functions as a determination unit configured to determine a ground state of the foot region, a first control unit configured to force-control the linear motion actuator such that a raising force $f_{swing}$ is applied according to the flexure amount $\theta_{HPJ}$ of the hip joint of the user in the leg rod of the swing leg side, and a second control unit configured to force-control the linear motion actuator such that a pressing force $F_{stance}$ is applied to support the weight according to the flexure amount $\theta_{KPJ}$ of the knee of the user in the leg rod of the stance leg side.

Hereinabove, the technology of the present disclosure has been described in detail with reference to the specific embodiments. However, it will be apparent to those skilled in the art that amendments and substitutions of the embodiments may be made without departing from the spirit of the technology of the present disclosure.

While the description is performed focusing on the embodiment to which the leg assist suit is applied, the spirit of the technology of the present disclosure is not limited thereto. The technology of the present disclosure can also be applied to various types of assist suits mounted on regions of a human other than leg portions, and various exercises of the human other than walking can be supported.

In conclusion, the technology of the present disclosure has been described for the purpose of exemplary illustration, and contents of the disclosure should not be interpreted to a limited extent. In order to determine the spirit of the technology of the present disclosure, the scope of the claims should be considered.

What is claimed is:

1. An exercise support apparatus comprising:

a plurality of leg rods, each leg rod of the plurality of leg rods configured to be connected to a waist region and a foot region of a user and including a linear motion actuator, wherein each leg rod includes a rail and a slider configured to be connected to one another at overlapping sections of the rail and the slider, and wherein the rail and the slider are each curved such that an operation of the linear motion actuator performed on one or more of the overlapping sections changes an amount of overlap between the overlapping sections and results in a curved trajectory of at least one of the rail and the slider at a point of connection between the rail and the slider;

a plurality of waist connecting sections, each waist connecting section configured to connect one end of a respective leg rod of the plurality of leg rods to the waist region; and a plurality of foot region connecting sections, each foot region connecting section configured to connect another end of the respective leg rod to the foot region.

2. The exercise support apparatus according to claim 1, wherein the linear motion actuator of each leg rod is configured to expand and contract the amount of overlap between the overlapping sections of the leg rod by applying a force in a longitudinal direction during the operation.

3. The exercise support apparatus according to claim 1, wherein each waist connecting section and each foot region connecting section are connected to the one end and the other end of the respective leg rod such that each one of the plurality of leg rods is configured to be disposed inside both left and right legs of the user.

4. The exercise support apparatus according to claim 1, further comprising an outfit configured to be worn by the user at a trunk and having the plurality of waist connecting sections.

5. The exercise support apparatus according to claim 4, wherein the outfit is configured to connect to the one end of each leg rod via the waist connecting section for the respective leg rod in a vicinity of an anterior abdomen of the user.

6. The exercise support apparatus according to claim 4, wherein the outfit is configured to transmit one direction upward force generated by the linear motion actuator of each leg rod to a pelvis of the user.

7. The exercise support apparatus according to claim 4, wherein the outfit includes a thigh harness configured to annularly surround a thigh region of each leg of the user, a waist harness configured to annularly surround the waist region of the user and connected to the one end of each leg rod, and a substantially linear connecting harness configured to connect the waist harness and the thigh harness.

8. The exercise support apparatus according to claim 7, wherein, when the linear motion actuator of each leg rod is expanded and the waist harness is raised upward, as the thigh harness is raised via the connecting harness, an upward force is configured to be transmitted to a pelvis of the user.

9. The exercise support apparatus according to claim 1, further comprising a plurality of plantar regions, each plantar region configured to connect a respective foot region connecting section having three rotational degrees of freedom such that a rotational center of each foot region connecting section is configured to be disposed in the vicinity of a subhallucal region of the foot region of the user in forward and rearward directions and in the vicinity of a center of the plantar of the user in a widthwise direction thereof.

10. The exercise support apparatus according to claim 1, wherein each waist connecting section connects to the one end of the respective leg rod in a vicinity of a center in a widthwise direction of a pelvis of the user.

11. The exercise support apparatus according to claim 10, wherein the plurality of leg rods comprises a left leg rod configured to be installed at a left leg of the user and a right leg rod configured to be installed at a right leg of the user, and wherein the plurality of waist connecting sections configured to connect to each one of the left leg rod and the right leg rod are disposed to be concentrated at one point.

12. The exercise support apparatus according to claim 1, wherein each leg rod is configured to curve toward a front section of a body of the user.

13. The exercise support apparatus according to claim 1, wherein the plurality of leg rods comprises a left leg rod configured to be installed at a left leg of the user and a right leg rod configured to be installed at a right leg of the user, and wherein each waist connecting section restricts a movable range about a hip roll joint of one of the left rod and the right leg rod.

14. The exercise support apparatus according to claim 1, further comprising:

a force sensor configured to detect an external force applied to the linear motion actuator of each leg rod; and a control part configured to force-control the linear motion actuator based on an output value of the force sensor.

15. The exercise support apparatus according to claim 1, further comprising:

a ground sensor configured to detect a ground state of a sole of the foot region configured to be connected to each leg rod; and a control part configured to control a motion of the linear motion actuator of each leg rod based on an output value of the ground sensor.

16. The exercise support apparatus according to claim 1, further comprising a control part configured to force-control the linear motion actuator of each leg rod such that a pressing force ($F_{stance}$) is applied to support a weight according to a flexure amount ($\theta_{KPJ}$) of a knee of the user when the leg rod is determined to be on a stance leg side, and such that a raising force ($f_{swing}$) is applied according to a flexure amount ($\theta_{HPJ}$) of a hip joint of the user when the leg rod is determined to be on a swing leg side.

17. The exercise support apparatus according to claim 16, further comprising:

an encoder configured to detect a position of the linear motion actuator of each leg rod, wherein the control part approximates the flexure amount ($\theta_{KPJ}$) of the knee of the user and a flexure amount ($\theta_{KPJ}$) of each leg rod at a respective position of the linear motion actuator.

18. The exercise support apparatus according to claim 16, wherein the control part force-controls the linear motion actuator of each leg rod in consideration of a force for self-weight compensation to the pressing force ($F_{stance}$) when the leg rod is determined to be on the stance leg side and the raising force ($f_{swing}$) when the leg rod is determined to be on the swing leg side.

19. The exercise support apparatus according to claim 16, wherein the control part force-controls the linear motion actuator of each leg rod so that the raising force ($f_{swing}$) for the leg rod determined to be on the swing leg side is not applied to the leg rod determined to be on the stance leg side.

20. An exercise support method of supporting an exercise of a user, the method comprising:

providing the exercise support apparatus according to claim 1;

determining a ground state of the foot region configured to be connected to each leg rod;

force-controlling the linear motion actuator of each leg rod to apply a raising force ($f_{swing}$) according to a flexure amount ($\theta_{HPJ}$) of a hip joint of the user when the leg rod is determined to be on a swing leg side; and force-controlling the linear motion actuator of each leg rod such that a pressing force ($F_{stance}$) is applied to support a weight according to a flexure amount ($\theta_{KPJ}$) of the knee of the user when the leg rod is determined to be on a stance leg side.

* * * * *